US011362424B2

(12) United States Patent
Park et al.

(10) Patent No.: US 11,362,424 B2
(45) Date of Patent: Jun. 14, 2022

(54) ANTENNA MODULE AND ELECTRONIC DEVICE COMPRISING THEREOF

(71) Applicant: Samsung Electronics Co., Ltd., Suwon-si (KR)

(72) Inventors: Jinwoo Park, Suwon-si (KR); Kyujin Kwak, Suwon-si (KR); Jinho Lim, Suwon-si (KR); Dongyeon Kim, Suwon-si (KR); Jungsik Park, Suwon-si (KR); Sungjun Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 148 days.

(21) Appl. No.: 16/707,315

(22) Filed: Dec. 9, 2019

(65) Prior Publication Data

US 2020/0203836 A1 Jun. 25, 2020

(30) Foreign Application Priority Data

Dec. 21, 2018 (KR) ..... 10-2018-0166920

(51) Int. Cl.
*H01Q 1/24* (2006.01)
*H01Q 9/04* (2006.01)
*H01Q 1/22* (2006.01)

(52) U.S. Cl.
CPC ..... *H01Q 9/0414* (2013.01); *H01Q 1/2283* (2013.01); *H01Q 1/242* (2013.01); *H01Q 9/045* (2013.01)

(58) Field of Classification Search
CPC .... H01Q 9/0414; H01Q 1/242; H01Q 1/2283; H01Q 9/045
See application file for complete search history.

(56) References Cited

U.S. PATENT DOCUMENTS 6,639,556 B2 10/2003 Baba
7,408,510 B2 8/2008 Yamamoto et al.
(Continued)

FOREIGN PATENT DOCUMENTS

EP 2 270 924 A1 1/2011
EP 2 709 205 A1 3/2014
(Continued)

OTHER PUBLICATIONS

International Search Report dated Apr. 6, 2020, Issued in International Application No. PCT/KR2019/017364.
(Continued)

*Primary Examiner* — Dieu Hien T Duong
(74) *Attorney, Agent, or Firm* — Jefferson IP Law, LLP

(57) ABSTRACT

An electronic device is provided. The electronic device includes a housing, a plate attached to the housing to form an inner space together with the housing and includes a flat portion facing in a first direction and a curved portion extended from an edge of the flat portion and forming an obtuse angle with the first direction, and an antenna module positioned in the inner space. The antenna module includes a first partial layer, a second partial layer that includes a first antenna pattern, and is stacked on the first partial layer, and a third partial layer that includes a second antenna pattern, and is stacked on the second partial layer. When viewed from the first direction, the third partial layer overlaps at least a portion of the flat portion, and at least a portion of the second partial layer overlaps at least a portion of the curved portion.

15 Claims, 18 Drawing Sheets

(56) References Cited

U.S. PATENT DOCUMENTS

| | | | | |
|---|---|---|---|---|
| 8,633,856 | B2 | 1/2014 | Rao | |
| 9,640,859 | B2 | 5/2017 | Lim | |
| 9,746,882 | B2 | 8/2017 | Song et al. | |
| 9,804,418 | B2 | 10/2017 | Pugh et al. | |
| 10,305,172 | B2 | 5/2019 | Noori et al. | |
| 10,498,025 | B2 | 12/2019 | Mizunuma et al. | |
| 11,024,938 | B2 | 6/2021 | Moon et al. | |
| 11,114,741 | B2 | 9/2021 | Moon et al. | |
| 2002/0041255 | A1 | 4/2002 | Baba | |
| 2006/0227051 | A1 | 10/2006 | Yamamoto et al. | |
| 2012/0242953 | A1 | 9/2012 | Pugh et al. | |
| 2013/0214046 | A1 | 8/2013 | Choi et al. | |
| 2017/0062899 | A1* | 3/2017 | Takahashi | H01Q 1/02 |
| 2017/0222316 | A1 | 8/2017 | Mizunuma et al. | |
| 2017/0309992 | A1 | 10/2017 | Noori et al. | |
| 2020/0119453 | A1* | 4/2020 | Takayama | H04B 1/18 |

FOREIGN PATENT DOCUMENTS

| | | | |
|---|---|---|---|
| EP | 3 703 346 | A1 | 9/2020 |
| JP | 2012-119953 | A | 6/2012 |
| KR | 10-2015-0041724 | A | 4/2015 |
| KR | 10-2016-0097106 | A | 8/2016 |

OTHER PUBLICATIONS

Extended European Search Report dated Nov. 16, 2021, issued in European Application No. 19900365.8.

* cited by examiner

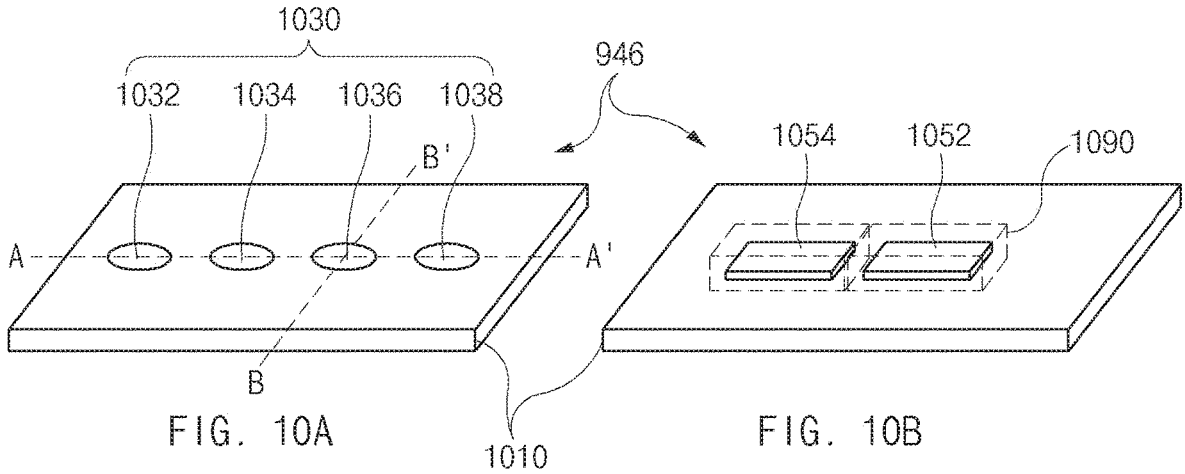
FIG. 10A
FIG. 10B
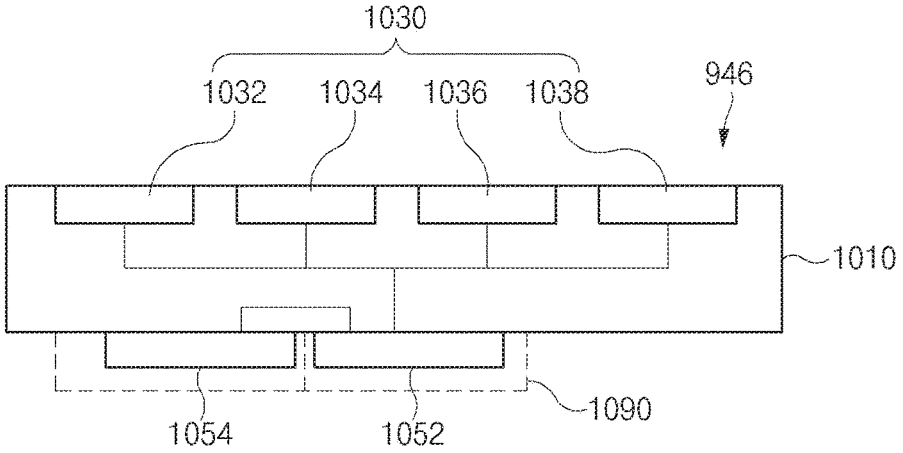
FIG. 10C

ANTENNA MODULE AND ELECTRONIC DEVICE COMPRISING THEREOF

CROSS-REFERENCE TO RELATED APPLICATION(S)

This application is based on and claims priority under 35 U.S.C. § 119(a) of a Korean patent application number 10-2018-0166920, filed on Dec. 21, 2018, in the Korean Intellectual Property Office, the disclosure of which is incorporated by reference herein its entirety.

BACKGROUND

1. Field

The disclosure relates to a technology for an antenna structure.

2. Description of Related Art

When an antenna operates at a relatively low frequency (e.g., 3 gigahertz (GHz) or low), the antenna may utilize a metal material of a housing of an electronic device as a radiator. However, this scheme is unavailable to an antenna that operates at a high frequency (e.g., 6 GHz or high) having strong straightness. An antenna that operates at a relatively high frequency may be mounted within an electronic device as a separate module.

When radio waves are emitted, the antenna module may have an influence of a material of the housing forming the exterior of the electronic device. In particular, in recent mobile electronic devices, a portion of the housing is formed of a metal material.

The above information is presented as background information only to assist with an understanding of the disclosure. No determination has been made, and no assertion is made, as to whether any of the above might be applicable as prior art with regard to the disclosure.

SUMMARY

In the case of an electronic device including a housing of a metal material, a radio frequency (RF) signal that is emitted from an antenna module may have an influence of the metal material of the housing.

Aspects of the disclosure are to address at least the above-mentioned problems and/or disadvantages and to provide at least the advantages described below. Accordingly, an aspect of the disclosure is to provide an electronic device that minimizes an influence of a metal component of a housing by applying a stepped structure to an antenna module such that a spaced distance between the metal component of the housing and the antenna module is maximized within the electronic device.

In accordance with an aspect of the disclosure, an electronic device is provided. The electronic device includes a housing, a plate that is attached to the housing to form an inner space together with the housing and includes a flat portion facing in a first direction and a curved portion extended from an edge of the flat portion and forming an obtuse angle with the first direction, and an antenna module that is positioned in the inner space. The antenna module may include a first partial layer that has a first size, a second partial layer including a first antenna pattern, has a second size smaller than the first size, and is stacked on the first partial layer, and a third partial layer that includes a second antenna pattern, has a third size smaller than the second size, and is stacked on the second partial layer. When viewed from the first direction, the third partial layer may overlap at least a portion of the flat portion, and at least a portion of the second partial layer may overlap at least a portion of the curved portion.

In accordance with another aspect of the disclosure, an antenna structure is provided. The antenna structure includes a first portion that has a first thickness and include a first antenna pattern, a second portion that has a second thickness smaller than the first thickness and includes a second antenna pattern, and a third portion that has a third thickness smaller than the first thickness.

In accordance with another aspect of the disclosure, an electronic device is provided. The electronic device includes a housing, a glass plate that is attached to the housing to form an inner space together with the housing and includes a flat portion facing in a first direction and a curved portion extended from an edge of the flat portion and forming an obtuse angle with the first direction, and an antenna structure that is positioned in the inner space. The antenna structure may include a first portion that overlaps at least a portion of the flat portion, when viewed from above the glass plate, has a first thickness, and includes a first surface facing in the first direction, and a second portion that overlaps at least a portion of the curved portion, when viewed from above the glass plate, has a second thickness smaller than the first thickness, and includes a second surface facing in the first direction. A first distance between the flat portion and the first surface may be smaller than a second distance between the curved portion and the second surface.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIGS. 10A, 10B, and 10C illustrate a structure of a third antenna module described with reference to FIG. 9, according to various embodiments of the disclosure.

Throughout the drawings, like reference numerals will be understood to refer to like parts, components and structures.

DETAILED DESCRIPTION

The following description with reference to accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modification of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
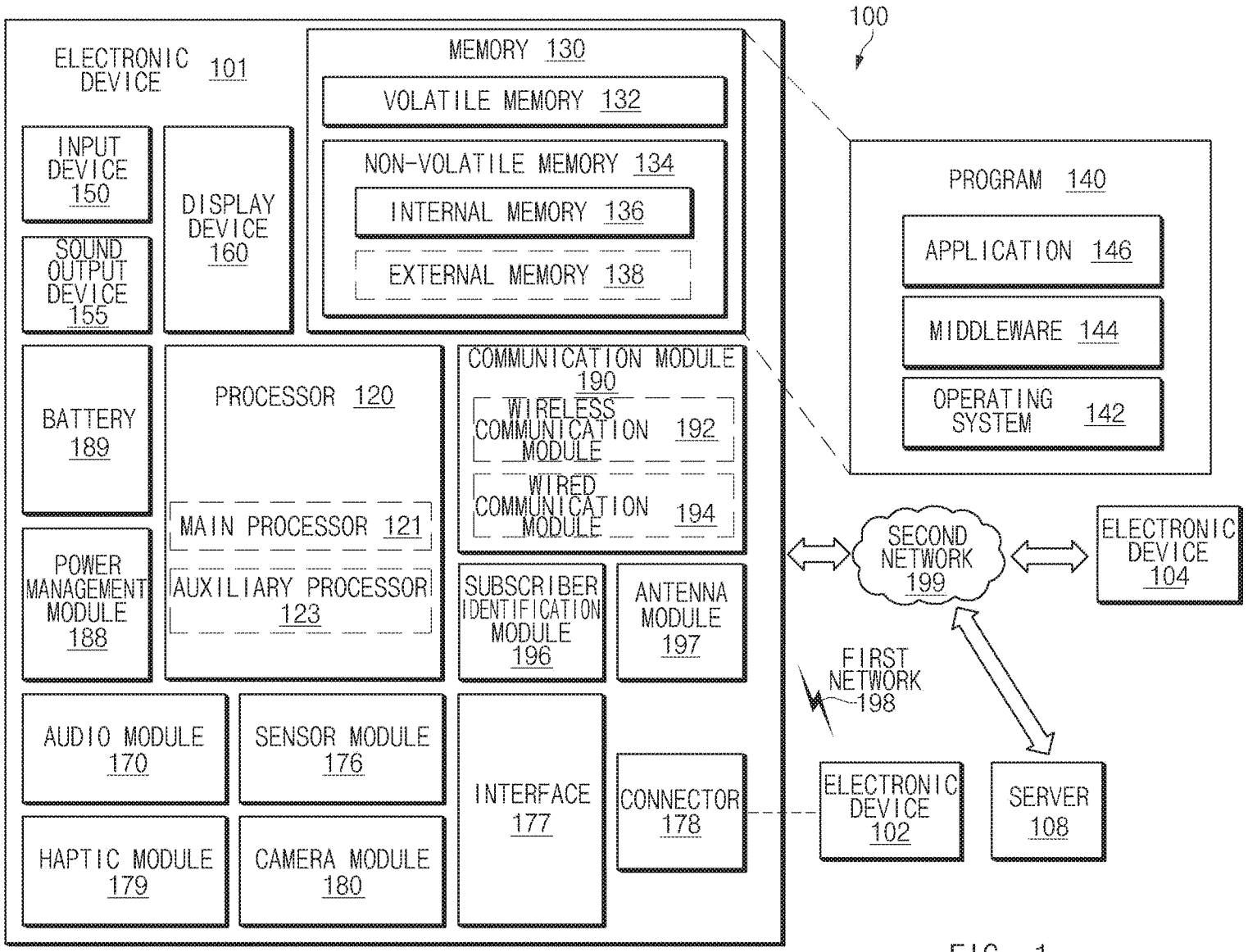
FIG. 1 is a block diagram illustrating an electronic device in a network environment according to an embodiment of the disclosure.

FIG. 1 is a block diagram illustrating an electronic device in a network environment according to an embodiment of the disclosure.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thererto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by another component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™ wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2A:
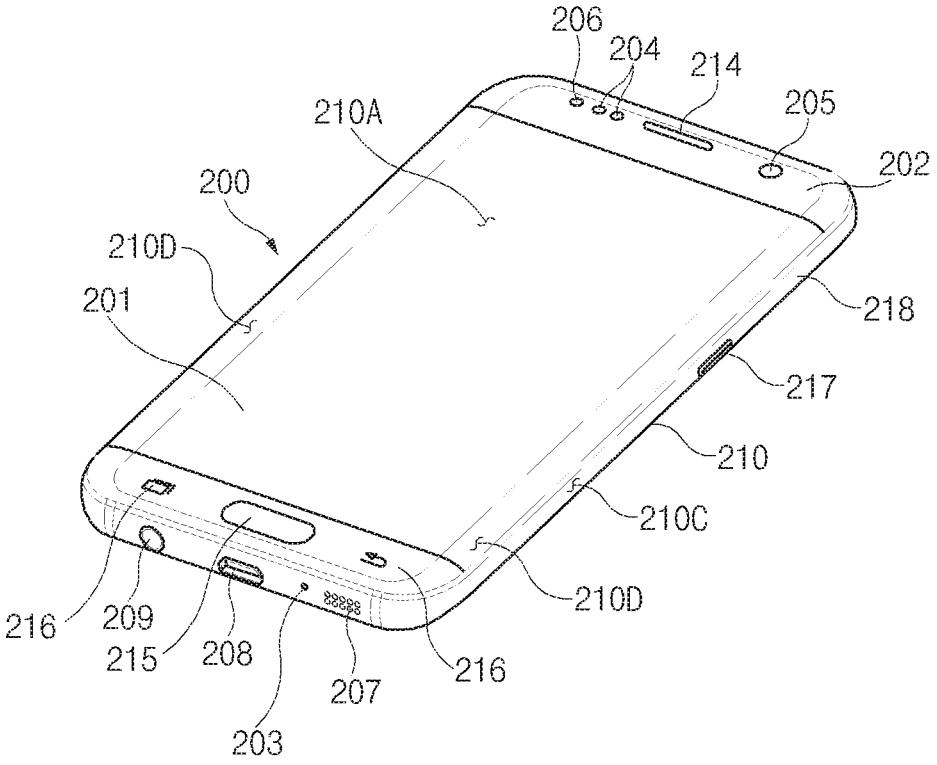
FIG. 2A is a front perspective view of a mobile electronic device according to an embodiment of the disclosure.

FIG. 2A is a front perspective view of a mobile electronic device according to an embodiment of the disclosure.

Figure 2B:
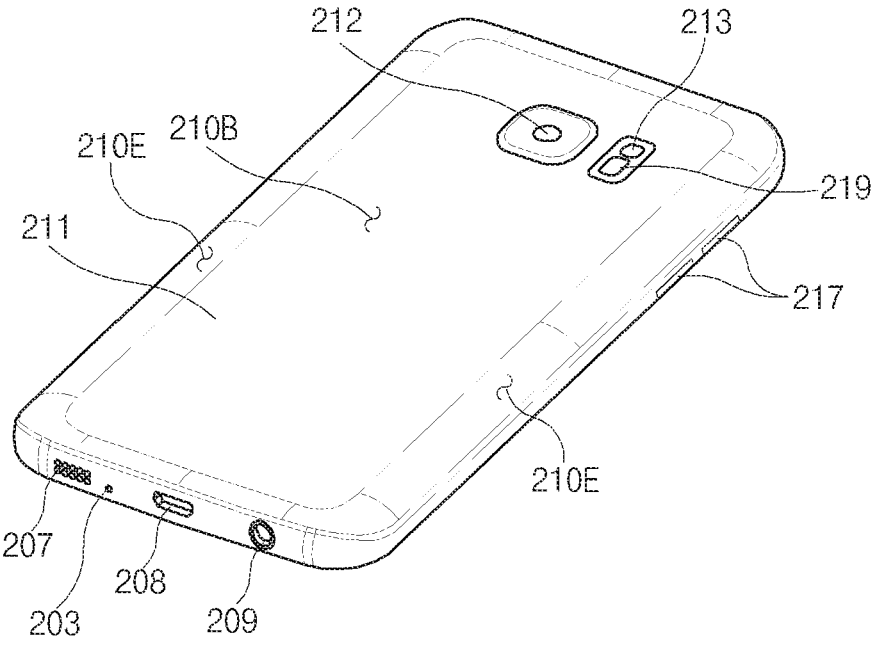
FIG. 2B is a back perspective view of an electronic device of FIG. 2A according to an embodiment of the disclosure.

FIG. 2B is a back perspective view of an electronic device of FIG. 2A according to an embodiment of the disclosure.

Referring to FIGS. 2A and 2B, an electronic device 200 (e.g., the electronic device 101) according to an embodiment may include a housing 210 including a first surface (or a front surface) 210A, a second surface (or a back surface) 210B, and a side surface 210C surrounding a space between the first surface 210A and the second surface 210B. In another embodiment (not illustrated), a housing may refer to a structure that forms a part of the first surface 210A, the second surface 210B, and the side surfaces 210C of FIG. 2A. According to an embodiment, the first surface 210A may be formed by a front plate 202 (e.g., a glass plate including various coating layers, or a polymer plate), of which at least a portion is substantially transparent. The second surface 210B may be formed by a back plate 211 that is substantially opaque. For example, the back plate 211 may be implemented with a coated or colored glass, a ceramic, a polymer, a metal (e.g., aluminum, stainless steel (STS), or magnesium), or a combination of at least two of the materials. The side surface 210C may be coupled to the front plate 202 or the back plate 211 and may be implemented with a side bezel structure (or a "side member") 218 including a metal and/or a polymer. In an embodiment, the back plate 211 and the side bezel structure 218 may be integrally formed and may include the same material (e.g., a metal material such as aluminum).

In the embodiment that is illustrated, the front plate 202 may include two first regions 210D, which are bent toward the back plate 211 from the first surface 210A so as to be seamlessly extended, at opposite long edges of the front plate 202. In the embodiment that is illustrated (refer to FIG. 2), the back plate 211 may include two second regions 210E, which are bent toward the front plate 202 from the second surface 210B so as to be seamlessly extended, at opposite long edges of the back plate 211. In an embodiment, the front plate 202 (or the back plate 211) may include only one of the first regions 210D (or the second regions 210E). In another embodiment, a portion of the first regions 210D or the second regions 210E may not be included. In the embodiments, when viewed from the side of the electronic device 200, the side bezel structure 218 may have a first thickness (or width) on one side where the first regions 210D or the second regions 210E are not included, and may have a second thickness on one side where the first regions 210D or the second regions 210E are included. The second thickness may be smaller than the first thickness.

According to an embodiment, the electronic device 200 may include at least one or more of a display 201, an audio module (203, 207, 214), a sensor module (204, 219), a camera module (205, 212, 213), a key input device (215, 216, 217), an indicator 206, and a connector hole (208, 209). In an embodiment, the electronic device 200 may not include at least one (e.g., the key input device (215, 216, 217) or the indicator 206) of the components or may further include any other component.

The display 201 may be exposed through a considerable portion of the front plate 202, for example. In an embodiment, at least a portion of the display 201 may be exposed through the first surface 210A, and the front plate 202 forming the first regions 210D of the side surface 210C. The display 201 may be coupled to a touch sensing circuit, a pressure sensor capable of measuring the intensity (or pressure) of a touch, and/or a digitizer detecting a magnetic stylus pen or may be positioned adjacent thereto. In an embodiment, at least a portion of the sensor module (204, 219) and/or at least a portion of the key input device (215, 216, 217) may be disposed in the first regions 210D and/or the second regions 210E.

The audio module (203, 207, 214) may include a microphone hole 203 and a speaker hole (207, 214). A microphone for obtaining external sound may be disposed within the microphone hole 203. In an embodiment, a plurality of microphones may be disposed to make it possible to detect a direction of sound. The speaker hole (207, 214) may include an external speaker hole 207 and a receiver hole 214 for call. In an embodiment, the speaker hole (207, 214) and the microphone hole 203 may be implemented with one hole, or a speaker (e.g., a piezoelectric speaker) may be included without the speaker hole (207, 214).

The sensor module (204, 219) may generate an electrical signal or a data value that corresponds to an internal operation state of the electronic device 200 or corresponds to an external environment state. The sensor module (204, 219) may include, for example, the first sensor module 204 (e.g., a proximity sensor) and/or a second sensor module (not illustrated) (e.g., a fingerprint sensor) disposed on the first surface 210A of the housing 210, and/or the third sensor module 219 (e.g., a heart rate monitor (HRM) sensor) disposed on the second surface 210B of the housing 210. The fingerprint sensor may be disposed on the second surface 210B as well as the first surface 210A (e.g., the home key button 215) of the housing 210. The electronic device 200 may further include a sensor module not illustrated, for example, at least one of a gesture sensor, a gyro sensor, a barometric pressure sensor, a magnetic sensor, an acceleration sensor, a grip sensor, a color sensor, an infrared (IR) sensor, a biometric sensor, a temperature sensor, a humidity sensor, or an illumination sensor 204.

The camera module (205, 212, 213) may include the first camera device 205 disposed on the first surface 210A of the electronic device 200, and the second camera module 212 and/or the flash 213 disposed on the second surface 210B thereof. The camera devices 205 and 212 may include one or more lenses, an image sensor, and/or an image signal processor. The flash 213 may include, for example, a light emitting diode (LED) or a xenon lamp. In an embodiment, two or more lenses (e.g., an infrared camera and wide-angle and telephoto lenses) and image sensors may be disposed on one surface of the electronic device 200.

The key input device (215, 216, 217) may include the home key button 215 disposed on the first surface 210A of the housing 210, the touch pad 216 disposed in the vicinity of the home key button 215, and/or the side key button 217 disposed on the side surface 210C of the housing 210. In another embodiment, the electronic device 200 may not include all or a part of the key input devices 215, 216, and 217, and a key input device(s) not included in the electronic device 200 may be implemented on the display 201 in the form of a soft key.

The indicator 206 may be disposed, for example, on the first surface 210A of the housing 210. The indicator 206 may provide status information of the electronic device 200, for example, in the form of light, and may include an LED.

The connector hole (208, 209) may include the first connector hole 208 that is capable of accommodating a connector (e.g., a USB connector) for transmitting/receiving a power and/or data to/from an external electronic device, and/or the second connector hole (or an earphone jack) 209 that is capable of accommodating a connector for transmitting/receiving an audio signal to/from the external electronic device.

Figure 3:
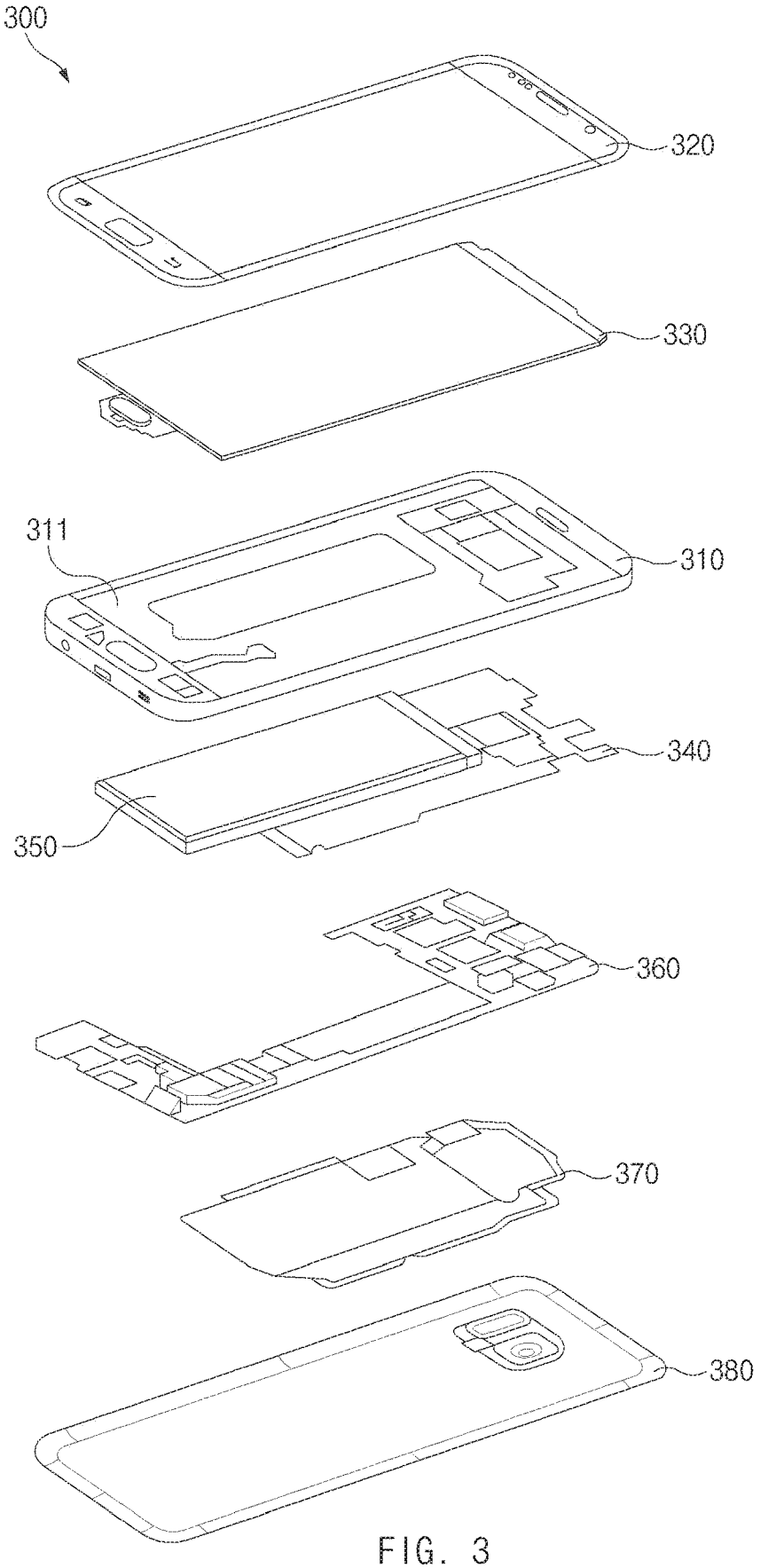
FIG. 3 is an exploded perspective view of an electronic device of FIG. 2A according to an embodiment of the disclosure.

FIG. 3 is an exploded perspective view of an electronic device of FIG. 2A according to an embodiment of the disclosure.

Referring to FIG. 3, an electronic device 300 may include a side bezel structure 310, a first support member 311 (e.g., a bracket), a front plate 320, a display 330, a printed circuit board 340, a battery 350, a second support member 360 (e.g., a rear case), an antenna 370, and a back plate 380. In an embodiment, the electronic device 300 may not include at least one (e.g., the first support member 311 or the second support member 360) of the components or may further include any other component. At least one of the components of the electronic device 300 may be similar to or the same as at least one of the components of the electronic device 200 of FIG. 2A or 2B, and thus, additional description will be omitted to avoid redundancy.

The first support member 311 may be disposed within the electronic device 300 so as to be connected with the side bezel structure 310, or may be integrally formed with the side bezel structure 310. The first support member 311 may be formed of, for example, a metal material and/or a nonmetal material (e.g., polymer). The display 330 may be coupled with one surface of the first support member 311, and the printed circuit board 340 may be coupled with an opposite surface of the first support member 311. A processor, a memory, and/or an interface may be mounted on the printed circuit board 340. For example, the processor may include one or more of a central processing unit, an application processor, a graphic processing device, an image signal processor, a sensor hub processor, or a communication processor.

The memory may include, for example, a volatile memory or a nonvolatile memory.

The interface may include, for example, an HDMI, a USB interface, an SD card interface, and/or an audio interface. The interface may electrically or physically connect, for example, the electronic device 300 with an external electronic device and may include a USB connector, an SD card/MMC connector, or an audio connector.

The battery 350 that is a device for supplying a power to at least one component of the electronic device 300 may include, for example, a primary cell incapable of being recharged, a secondary cell rechargeable, or a fuel cell. At least a portion of the battery 350 may be disposed on substantially the same plane as the printed circuit board 340, for example. The battery 350 may be integrally disposed within the electronic device 300, or may be disposed to be removable from the electronic device 300.

The antenna 370 may be interposed between the back plate 380 and the battery 350. The antenna 370 may include, for example, a near field communication (NFC) antenna, an antenna for wireless charging, and/or a magnetic secure transmission (MST) antenna. For example, the antenna 370 may perform short range communication with an external device or may wirelessly transmit/receive a power necessary to charge. In another embodiment, an antenna structure may be formed by a part of the first support member 311 and/or the side bezel structure 310, or by a combination thereof.

Figure 4A:
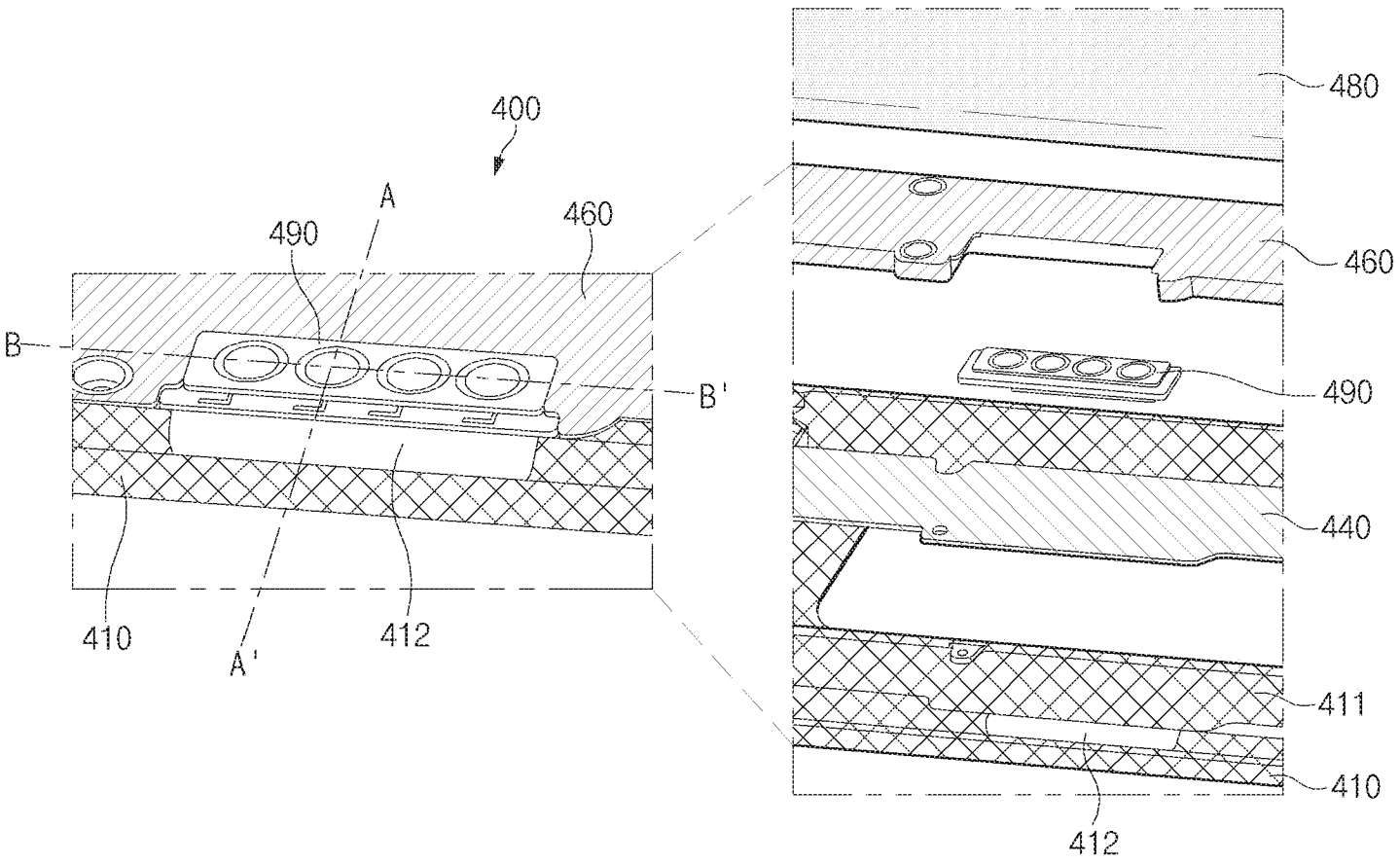
FIG. 4A is a view illustrating a portion of an electronic device including an antenna module according to an embodiment of the disclosure.

FIG. 4A is a view illustrating a portion of an electronic device including an antenna module according to an embodiment of the disclosure.

Figure 4B:
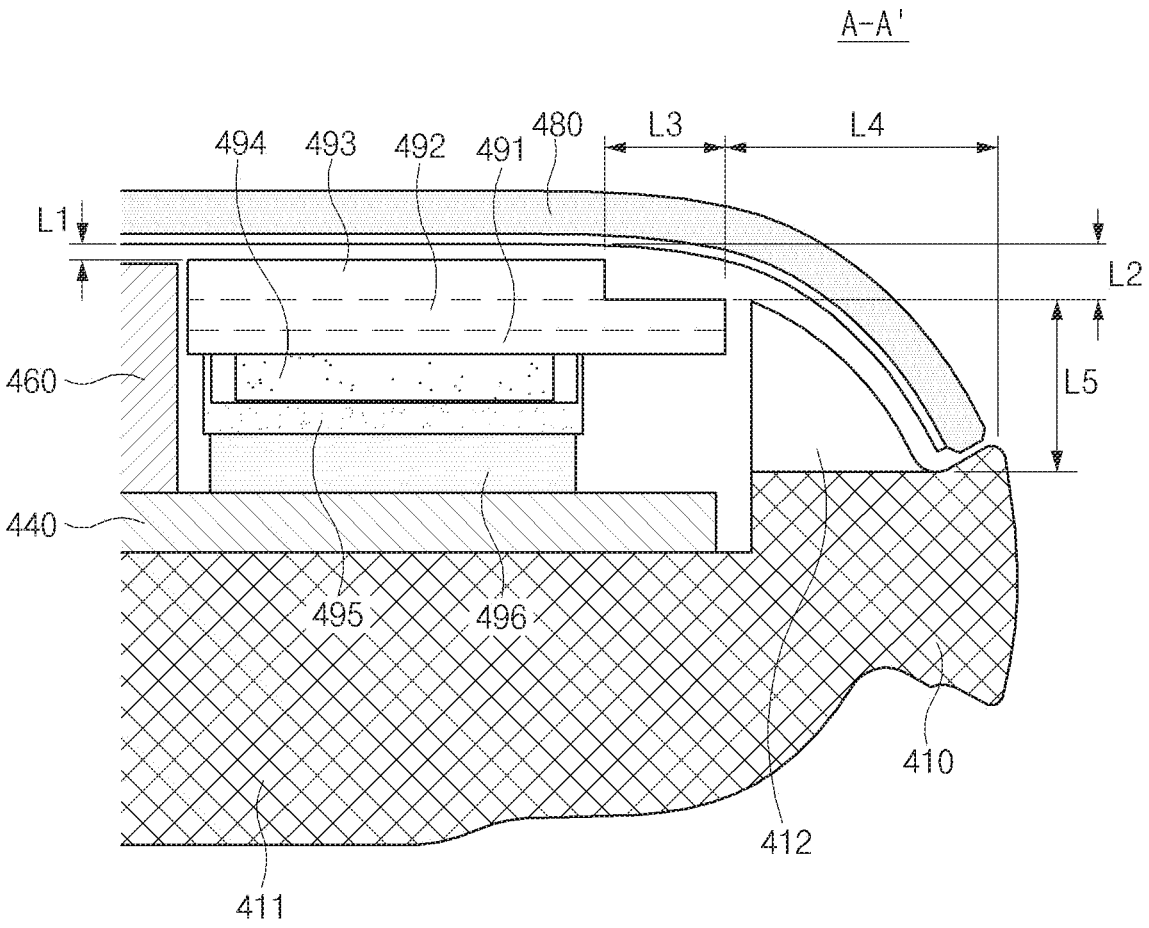
FIG. 4B is a cross-sectional view of an electronic device taken along a line A-A' of FIG. 4A according to an embodiment of the disclosure.
Figure 4C:
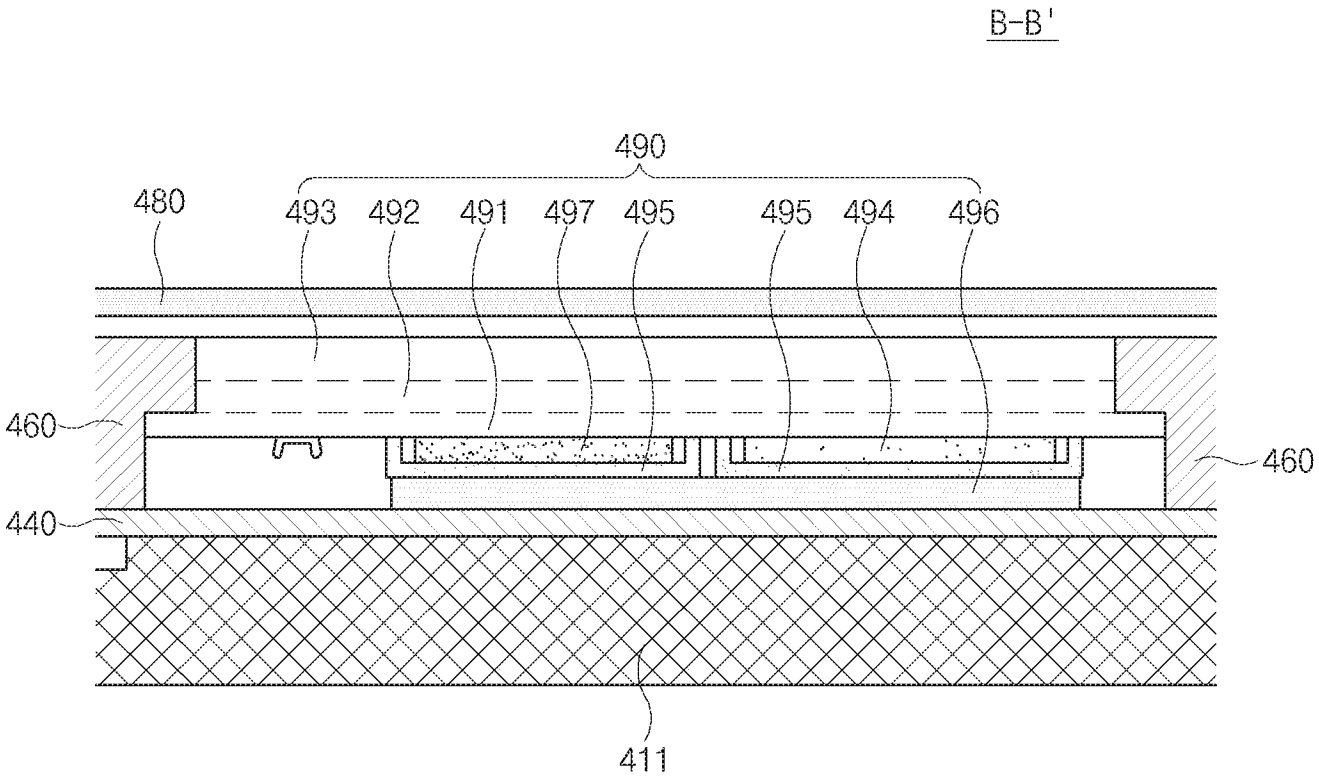
FIG. 4C is a cross-sectional view of an electronic device taken along a line B-B' of FIG. 4A according to an embodiment of the disclosure.
Figure 4D:
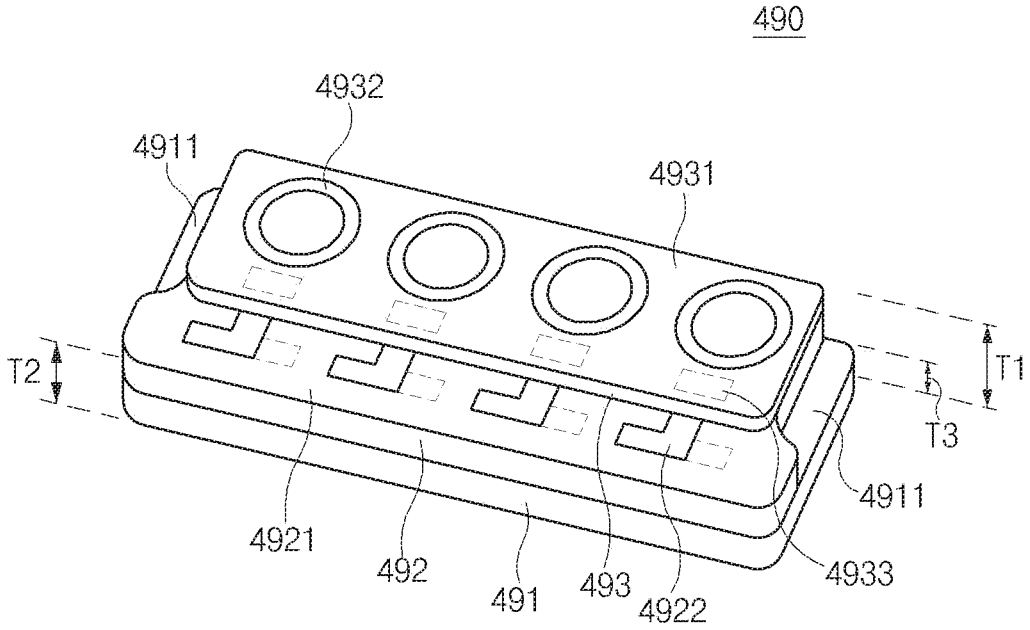
FIG. 4D is a view illustrating an antenna module of FIG. 4A in more detail according to an embodiment of the disclosure.

FIG. 4B is a cross-sectional view of an electronic device taken along a line A-A' of FIG. 4A according to an embodiment of the disclosure. FIG. 4C is a cross-sectional view of an electronic device taken along a line B-B' of FIG. 4A according to an embodiment of the disclosure. FIG. 4D is a view illustrating an antenna module of FIG. 4A in more detail according to an embodiment of the disclosure.

Referring to FIGS. 4A to 4D, an electronic device 400 (e.g., the electronic device 300) may include an antenna module 490 (e.g., an antenna structure) separated from a printed circuit board 440 (e.g., the printed circuit board 340).

According to an embodiment, the electronic device 400 may include a side bezel structure 410 (e.g., the side bezel structure 310), a first support member 411 (e.g., the first support member 311 or a bracket), the printed circuit board 440, a second support member 460 (e.g., the second support member 360 or the rear case), a back plate 480 (e.g., the back plate 380 or a back cover), and the antenna module 490. According to an embodiment, the electronic device 400 may not include at least one of the above components or may further include any other component(s).

According to an embodiment, the first support member 411 may be disposed within the electronic device 400 so as to be connected with the side bezel structure 410, or may be integrally formed with the side bezel structure 410. The first support member 411 may be formed of, for example, a metal material and/or a nonmetal material (e.g., polymer). A display (e.g., the display 330) may be coupled to one surface of the first support member 411, and the printed circuit board 440 may be coupled to an opposite surface of the first support member 411. A processor, a memory, and/or an interface may be mounted on the printed circuit board 440. For example, the processor may include one or more of a central processing unit, an application processor, a graphic processing device, an image signal processor, a sensor hub processor, or a communication processor. The second support member 460 may be coupled to one surface of the printed circuit board 440 (e.g., to a surface of the printed circuit board 440, which faces away from the surface to which the first support member 411 is coupled). The back plate 480 may be combined with the side bezel structure 410 to form an outer surface of the housing. The antenna module 490 may be interposed between the printed circuit board 440 and the second support member 460. For a smooth operation of the antenna module 490, the side bezel structure 410 may include an injection structure 412 at a location corresponding to the antenna module 490.

According to an embodiment, the antenna module 490 may include a plurality of partial layers 491, 492, and 493 (e.g., a small-sized printed circuit board separated from the printed circuit board 440), an RFIC 494, a shield can 495, a heat radiation member 496 (e.g., thermal interface materials (TIM)), and a PMIC 497. For example, the antenna module 490 may include an antenna (e.g., a dipole antenna or a patch antenna) to perform 5G communication. The antenna module 490 may include a communication circuit configured to transmit/receive a communication signal having a frequency between 3.5 GHz and 100 GHz.

According to an embodiment, the antenna module 490 may include a plurality of portions having different sizes. For example, the antenna module 490 may include the first to third partial layers 491, 492, and 493. The first partial layer 491 may have a first size. The second partial layer 492 may have a second size smaller than the first size. The third partial layer 493 may have a third size smaller than the second size. The first partial layer 491 may include a first region 4911 that is exposed to the outside due to a difference between the first partial layer 491 and the second partial layer 492. The second partial layer 492 may include a second region 4921 that is exposed to the outside due to a difference between the second partial layer 492 and the third partial layer 493. The third partial layer 493 may include a third region 4931 that is exposed to the outside. The antenna module 490 may be formed to have a stepped structure. Each of the first to third partial layers 491, 492, and 493 may be implemented with a printed circuit board having a plurality of layers.

According to various embodiments, the first region 4911 may be formed to have a different thickness from the first partial layer 491. For example, the first region 4911 may be formed in a cutting process after the first to third partial layers 491, 492, and 493 of the same size are stacked. Through the cutting process, the first region 4911 may be formed at a location where at least a portion of the first to third partial layers 491, 492, and 493 is removed.

According to an embodiment, the antenna module 490 may include at least one first region 4911. For example, the first regions 4911 may be formed on opposite sides of the antenna module 490, respectively. The first region 4911 may be formed to engage with a portion of the second support member 460. For example, as the first region 4911 and a portion of the second support member 460 are coupled, the antenna module 490 may be fixed to the printed circuit board 440. The portion of the second support member 460 may include a protrusion that is formed to have a shape corresponding to a shape of the first region 4911. An adhesive member may be attached to the first region 4911, and the first region 4911 and the portion of the second support member 460 may be coupled through the adhesive member. The first partial layer 491 may include a wire pattern for an operation of the antenna module 490.

According to an embodiment, the antenna module 490 may include at least one dipole antenna pattern 4922. For example, a portion of the dipole antenna pattern 4922 may be disposed at the second region 4921. Another portion of the dipole antenna pattern 4922 may be disposed at one of a plurality of layers. The dipole antenna pattern 4922 may be configured to transmit/receive a communication signal having a frequency between 3.5 GHz and 100 GHz.

According to an embodiment, the antenna module 490 may include at least one patch antenna pattern 4932. For example, the patch antenna pattern 4932 may be disposed at the third region 4931. The patch antenna pattern 4932 may be configured to transmit/receive a communication signal having a frequency between 3.5 GHz and 100 GHz.

According to an embodiment, the third region 4931 may have a first thickness T1. The second region 4921 may have a second thickness T2 smaller than the first thickness T1. The first region 4911 may have a third thickness T3 smaller than the first thickness T1. According to various embodiments, the first region 4911 may have the third thickness T3 smaller than the second thickness T2.

According to an embodiment, the first partial layer 491 or the third partial layer 493 may include at least one shorted patch (S-patch) antenna pattern 4933 improving the straightness of a communication signal that is transmitted/received by the dipole antenna pattern 4922. The S-patch antenna pattern 4933 may be disposed at a location vertically corresponding to the dipole antenna pattern 4922. An S-patch antenna pattern of the first partial layer 491 and the S-patch antenna pattern 4933 of the third partial layer 493 may be disposed to be paired. The dipole antenna pattern 4922 may be interposed between the S-patch antenna pattern of the first partial layer 491 and the S-patch antenna pattern 4933 of the third partial layer 493.

According to an embodiment, the back plate 480 may include a flat portion (e.g., the second surface 210B of the back plate 211) and a curved portion (e.g., the second region 210E of the back plate 211) seamlessly bent toward a front plate (e.g., the front plate 202) from the flat portion. The third region 4931 may be disposed to face the flat portion of the back plate 480. For example, when viewed from above the back plate 480, the third region 4931 may overlap at least a portion of the flat portion of the back plate 480. Also, the second region 4921 may be disposed to face the curved portion of the back plate 480. For example, when viewed from above the back plate 480, the second region 4921 may overlap at least a portion of the curved portion of the back plate 480.

According to an embodiment, the antenna module 490 (or the third region 4931) may be spaced from the flat portion of the back plate 480 as much as a first length L1. The antenna module 490 may be coupled to the second support member 460 through the first region 4911. Accordingly, the second support member 460 may not require a separate hook for fixing the antenna module 490, and the first length L1 may be decreased maximally. The second region 4921 may be spaced from the curved portion of the back plate 480 as much as a second length L2. The antenna module 490 may be disposed on one surface of the printed circuit board 440 such that the first length L1 is set to be smaller than the second length L2.

According to an embodiment, a portion of the antenna module 490 may be disposed on the outer side of the flat portion of the back plate 480 through the stepped structure. For example, the second partial layer 492 may be formed to be larger than the third partial layer 493 as much as a third length L3, and a portion of the second region 4921 may be disposed on the outer side of the flat portion of the back plate 480 as much as the third length L3. As a portion of the antenna module 490 is disposed on the outer side of the flat portion of the back plate 480, a beam performance of the antenna module 490 may be improved. The beam performance of the antenna module 490 may be improved as the antenna module 490 is disposed to be closer to an edge (or periphery) of the electronic device maximally (or as a fourth length L4 decreases) or as the antenna module 490 is spaced from the side bezel structure 410 formed of a metal material maximally (or as a fifth length L5 increases). Assuming that a stepped structure is absent from an antenna module, in the case where the antenna module moves to the edge (or periphery) and the fourth length L4 decreases, the fifth length L5 may decrease due to the curved portion of the back plate 480. In contrast, the antenna module 490 of the disclosure may decrease the fourth length L4 without a decrease in the fifth length L5 through the stepped structure, and thus, a beam performance of the antenna module 490 may be improved.

Figure 5A:
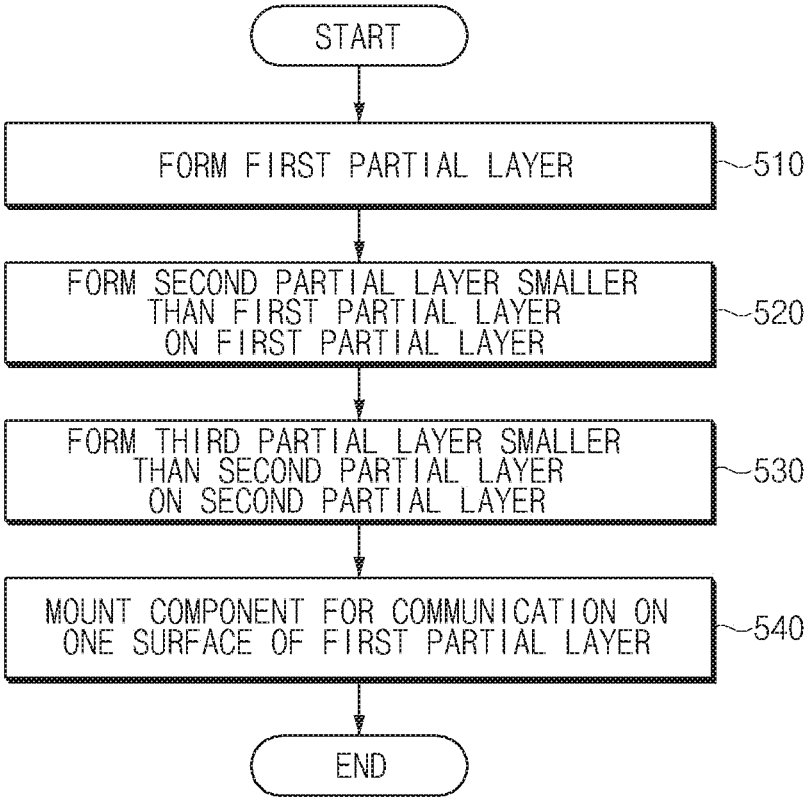
FIG. 5A is a flowchart illustrating a method for manufacturing an antenna module according to an embodiment of the disclosure.

FIG. 5A is a flowchart illustrating a method for manufacturing an antenna module according to an embodiment of the disclosure.

Figure 5B:
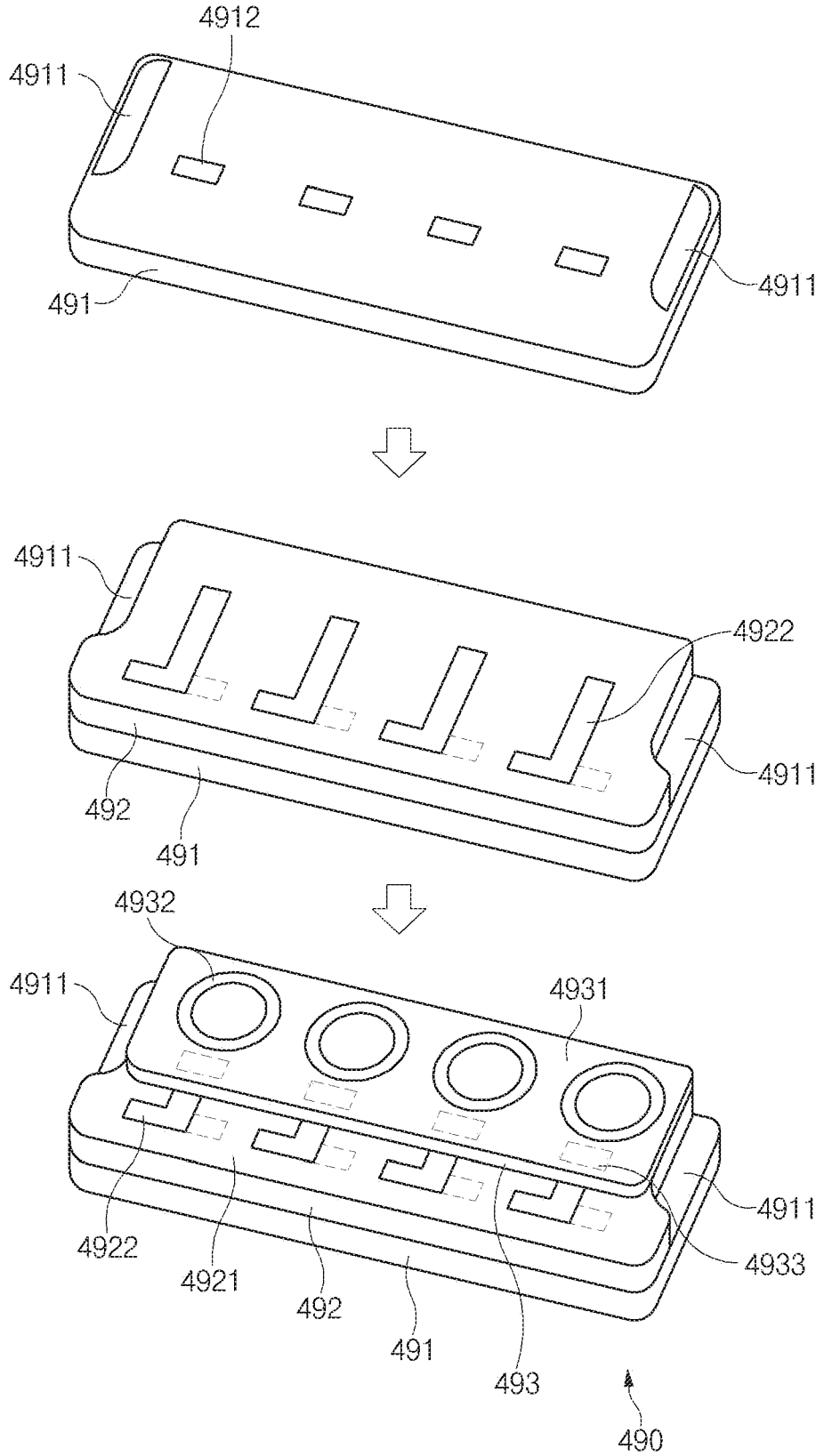
FIG. 5B is a view illustrating a process for manufacturing an antenna module according to an embodiment of the disclosure.

FIG. 5B is a view illustrating a process for manufacturing an antenna module according to an embodiment of the disclosure.

Referring to FIGS. 5A and 5B, the antenna module 490 may be manufactured to have a stepped structure. For example, the antenna module 490 may be manufactured by stacking the first to third partial layers 491, 492, and 493 having different sizes.

According to an embodiment, in operation 510, the first partial layer 491 may be formed. For example, the first partial layer 491 may have the first size. The first partial layer 491 may include a wire pattern for an operation of the antenna module 490 or an S-patch antenna pattern 4912 for improving the straightness of a communication signal that is transmitted/received by the dipole antenna pattern 4922. The S-patch antenna pattern 4912 of the first partial layer 491 and the S-patch antenna pattern 4933 of the third partial layer 493 may be disposed at corresponding locations so as to be paired. The first partial layer 491 may be formed by stacking a plurality of printed circuit boards.

According to an embodiment, in operation 520, the second partial layer 492 that is smaller than the first partial layer 491 may be formed. The second partial layer 492 may have the second size smaller than the first size. The second partial layer 492 may be stacked on the first partial layer 491. The second partial layer 492 may be manufactured to be smaller than the first partial layer 491 based on the specified size of the first region 4911. The first region 4911 may be formed to be exposed to the outside due to a difference between the first partial layer 491 and the second partial layer 492. The second partial layer 492 may include the dipole antenna pattern 4922. The dipole antenna pattern 4922 may be disposed at a location set to the second region 4921. The second partial layer 492 may be formed by stacking a plurality of printed circuit boards.

According to an embodiment, in operation 530, the third partial layer 493 that is smaller than the second partial layer 492 may be formed. For example, the third partial layer 493 may have the third size smaller than the second size. The third partial layer 493 may be stacked on the second partial layer 492. The third partial layer 493 may be manufactured to be smaller than the second partial layer 492 based on the specified size of the second region 4921. The second region 4921 may be formed to be exposed to the outside due to a difference between the second partial layer 492 and the third partial layer 493. The third partial layer 493 may include the patch antenna pattern 4932. The third partial layer 493 may include the S-patch antenna pattern 4933 for improving the straightness of a communication signal that is transmitted/received by the dipole antenna pattern 4922. The S-patch antenna pattern 4933 of the third partial layer 493 may be disposed at the corresponding location so as to be paired with the S-patch antenna pattern 4912 of the first partial layer 491. The third partial layer 493 may be formed by stacking a plurality of printed circuit boards.

According to an embodiment, in operation 540, components for communication may be mounted on one surface of the first partial layer 491. For example, an RFIC (e.g., the RFIC 494), a shield can (e.g., the shield can 495), and a PMIC (e.g., the PMIC 497) may be mounted on one surface of the first partial layer 491 (e.g., a surface of the first partial layer 491, which faces away from a surface on which the second partial layer 492 is stacked).

Figure 6A:
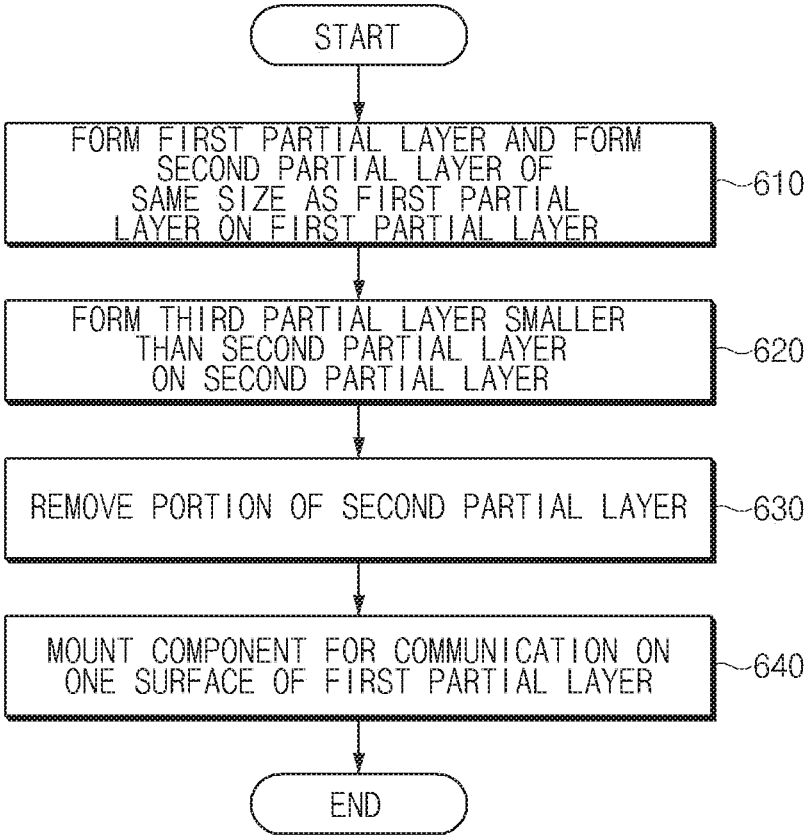
FIG. 6A is a flowchart illustrating a method for manufacturing an antenna module according to an embodiment of the disclosure.

FIG. 6A is a flowchart illustrating a method for manufacturing an antenna module according to an embodiment of the disclosure.

Figure 6B:
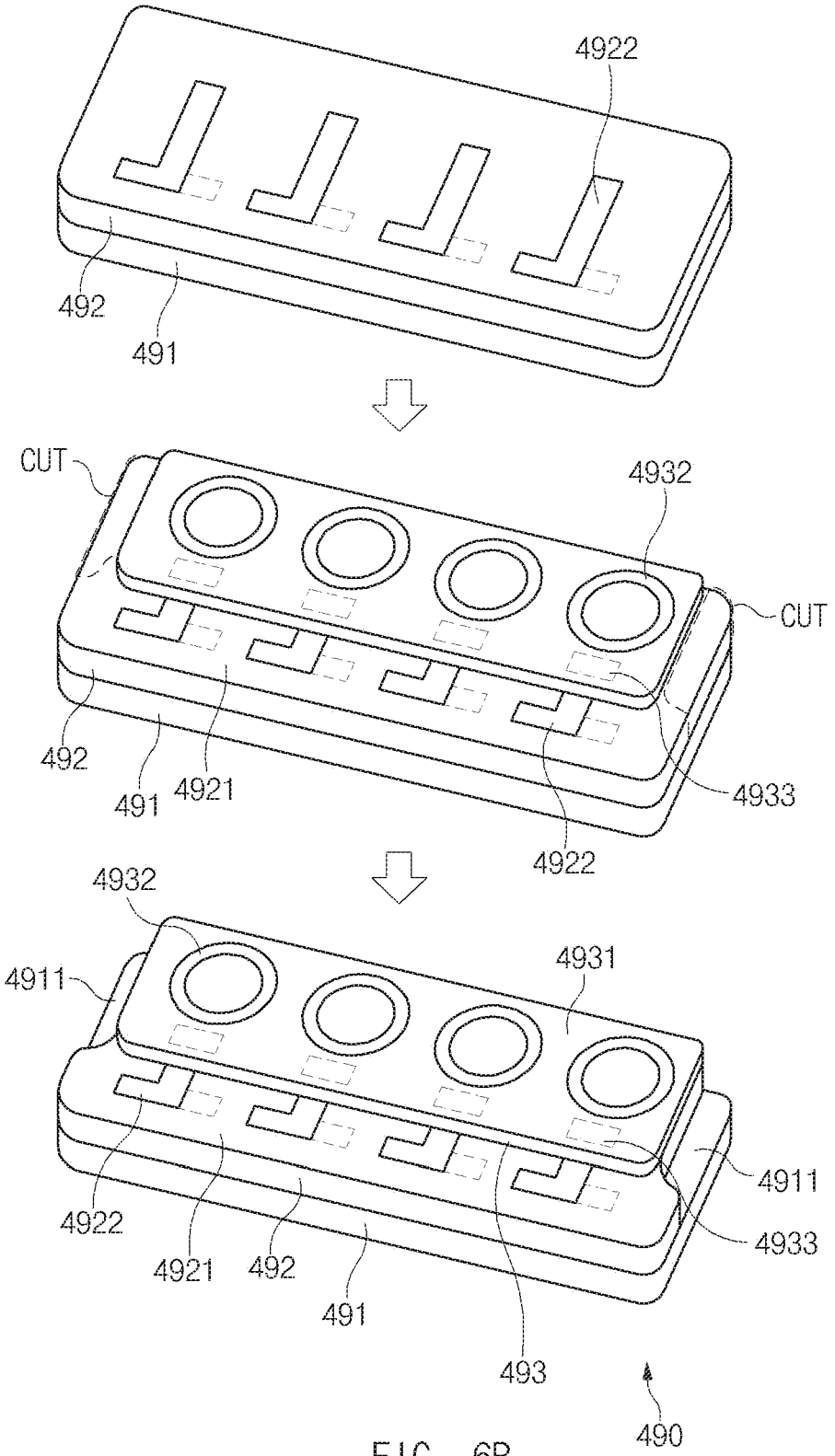
FIG. 6B is a view illustrating a process for manufacturing an antenna module according to an embodiment of the disclosure.

FIG. 6B is a view illustrating a process for manufacturing an antenna module according to an embodiment of the disclosure.

Referring to FIGS. 6A and 6B, the antenna module 490 may be manufactured to have a stepped structure. For example, the antenna module 490 may be manufactured by cutting a portion of the first to third partial layers 491, 492, and 493 so as to have the stepped structure.

According to an embodiment, in operation 610, the first partial layer 491 and the second partial layer 492 may be formed. For example, the first partial layer 491 and the second partial layer 492 may have the first size. The first partial layer 491 may include a wire pattern for an operation of the antenna module 490 or an S-patch antenna pattern (e.g., the S-patch antenna pattern 4912) for improving the straightness of a communication signal that is transmitted/received by the dipole antenna pattern 4922. The second partial layer 492 may be stacked on the first partial layer 491. The second partial layer 492 may include the dipole antenna pattern 4922. The dipole antenna pattern 4922 may be disposed at a location set to the second region 4921. The first partial layer 491 and the second partial layer 492 may be formed by stacking a plurality of printed circuit boards. The second partial layer 492 may be modified through a cutting process (i.e., CUT in FIG. 6B) so as to have the second size smaller than the first size.

According to an embodiment, in operation 620, the third partial layer 493 that is smaller than the second partial layer 492 may be formed. For example, the third partial layer 493 may have the third size smaller than the second size. The third partial layer 493 may be stacked on the second partial layer 492. The third partial layer 493 may be manufactured to be smaller than the second partial layer 492 based on the size of the first region 4911 to be formed later and the specified size of the second region 4921 The second region 4921 may be formed to be exposed to the outside due to a difference between the second partial layer 492 and the third partial layer 493. The third partial layer 493 may include the patch antenna pattern 4932. The third partial layer 493 may include the S-patch antenna pattern 4933 for improving the straightness of a communication signal that is transmitted/received by the dipole antenna pattern 4922. The S-patch antenna pattern 4933 of the third partial layer 493 may be disposed at the corresponding location so as to be paired with the S-patch antenna pattern of the first partial layer 491. The third partial layer 493 may be formed by stacking a plurality of printed circuit boards.

According to an embodiment, in operation 630, a portion of the second partial layer 492 may be removed. For example, a portion of the second partial layer 492, which corresponds to the first region 4911, may be removed through the cutting process (i.e., CUT in FIG. 6B). Through operation 630, the first region 4911 may be exposed to the outside. According to various embodiments, at least a portion of the first and second partial layers 491 and 492 may be removed through the cutting process. The first region 4911 may be formed on the first partial layer 491 or the second partial layer 492 so as to correspond to a shape of a support member (e.g., the second support member 460).

According to an embodiment, in operation 640, components for communication may be mounted on one surface of the first partial layer 491. For example, an RFIC (e.g., the RFIC 494), a shield can (e.g., the shield can 495), and a PMIC (e.g., the PMIC 497) may be mounted on one surface of the first partial layer 491 (e.g., a surface of the first partial layer 491, which faces away from a surface on which the second partial layer 492 is stacked).

Figure 7A:
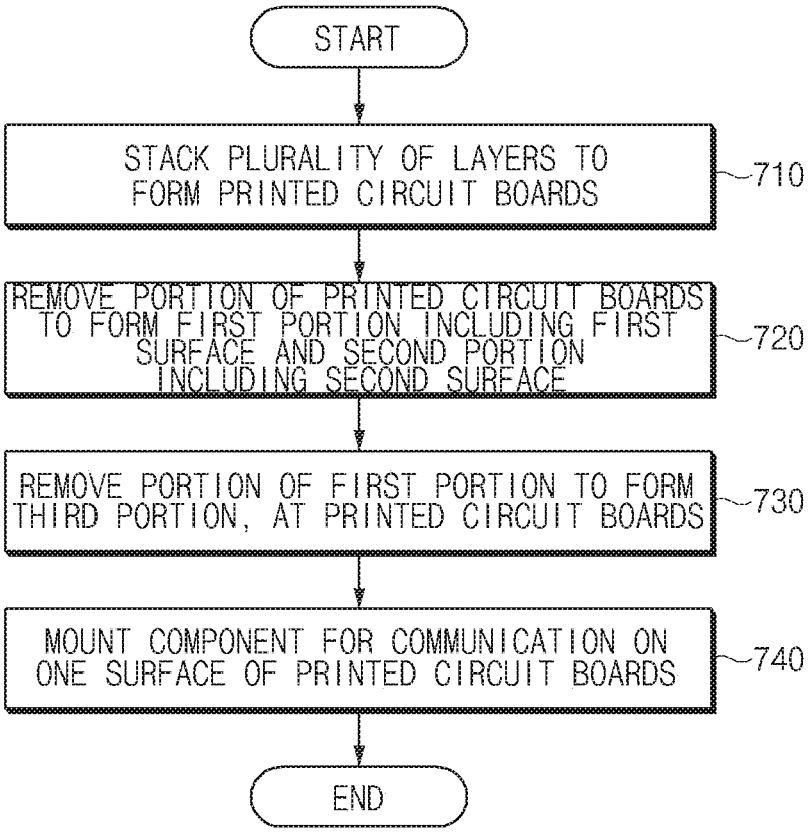
FIG. 7A is a flowchart illustrating a method for manufacturing an antenna module according to an embodiment of the disclosure.

FIG. 7A is a flowchart illustrating a method for manufacturing an antenna module according to an embodiment of the disclosure.

Figure 7B:
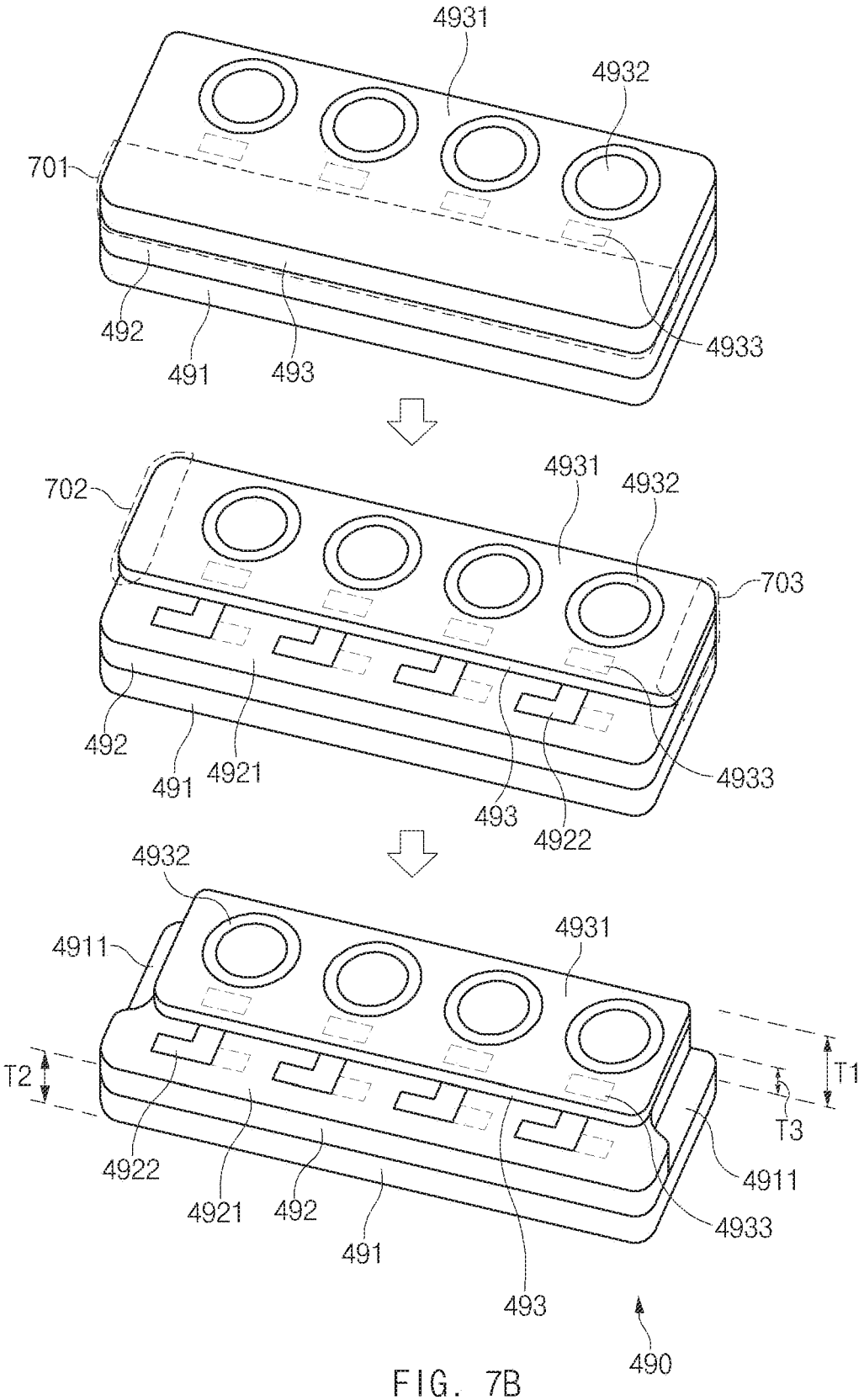
FIG. 7B is a view illustrating a process for manufacturing an antenna module according to an embodiment of the disclosure.

FIG. 7B is a view illustrating a process for manufacturing an antenna module according to an embodiment of the disclosure.

Referring to FIGS. 7A and 7B, the antenna module 490 may be manufactured by cutting a structure that is formed by stacking printed circuit boards. For example, the first region 4911 and the second region 4921 of the antenna module 490 may be formed through a cutting process.

According to an embodiment, in operation 710, a printed circuit board including a plurality of layers may be formed. For example, there may be stacked printed circuit boards of the same size, which constitute the first to third layers 491, 492, and 493. In the case of stacking the printed circuit boards, a portion of an S-patch antenna pattern may be disposed at the first partial layer 491, the dipole antenna pattern 4922 may be disposed at the second partial layer 492, and the patch antenna pattern 4932 and another portion of the S-patch antenna pattern 4933 may be disposed at the third partial layer 493.

According to an embodiment, in operation 720, a first portion (e.g., printed circuit boards under the third region 4931) including a first surface (e.g., a surface where the third region 4931 is formed) and a second portion (e.g., printed circuit boards under the second region 4921) including a second surface (e.g., a surface where the second region 4921 is formed) may be formed by removing a portion of the stacked printed circuit boards. For example, a portion of printed circuit boards stacked on the second region 4921 may be removed through a cutting process 701. A portion of the dipole antenna pattern 4922 may be exposed on a surface of the second region 4921 through the cutting process 701. The stacked printed circuit boards may be divided into the first portion and the second portion through the cutting process 701.

According to an embodiment, in operation 730, a third portion (e.g., printed circuit boards under the first region 4911) may be formed by removing a portion of the first portion. For example, the third portion may be formed through a cutting process (702, 703). At least a portion of the first to third partial layers 491, 492, and 493 may be removed through the cutting process (702, 703). Through the cutting process (702, 703), the first region 4911 may be formed at a location where at least a portion of the first to third partial layers 491, 492, and 493 is removed. The first region 4911 may be formed on the first partial layer 491, the second partial layer 492, or the third partial layer 493 so as to correspond to a shape of a support member (e.g., the second support member 460).

According to an embodiment, the first portion may have the first thickness T1. The second portion may have the second thickness T2 smaller than the first thickness T1. The third portion may have the third thickness T3 smaller than the first thickness T1. According to various embodiments, the third portion may have the third thickness T3 smaller than the second thickness T2.

According to an embodiment, in operation 740, components for communication may be mounted on one surface of the stacked printed circuit boards. For example, an RFIC (e.g., the RFIC 494), a shield can (e.g., the shield can 495), and a PMIC (e.g., the PMIC 497) may be mounted on one surface of the first partial layer 491 (e.g., a surface of the first partial layer 491, which faces away from a surface on which the second partial layer 492 is stacked).

As described above, an electronic device (e.g., the electronic device 101) may include a housing (e.g., the housing 210), a glass plate (e.g., the back plate 211) that is attached to the housing to form an inner space together with the housing and includes a flat portion (e.g., the second surface 210B of the back plate 211) facing in a first direction and a curved portion (e.g., the second region 210E of the back plate 211) extended from an edge of the flat portion and forming an obtuse angle with the first direction, and an antenna structure (e.g., the antenna module 490) that is positioned in the space. The antenna structure may include a first portion that overlaps at least a portion of the flat portion, when viewed from above the glass plate, has a first thickness (e.g., the first thickness T1), and includes a first surface (e.g., the third region 4931) facing in the first direction, and a second portion that overlaps at least a portion of the curved portion, when viewed from above the glass plate, has a second thickness (e.g., the second thickness T2) smaller than the first thickness, and includes a second surface facing in the first direction. A first distance (e.g., the first length L1) between the flat portion and the first surface may be smaller than a second distance (e.g., the second length L2) between the curved portion and the second surface.

According to various embodiments, the antenna structure may further include a third portion that overlaps another portion of the flat portion, when viewed from above the glass plate, has a third thickness (e.g., the third thickness T3) smaller than the first thickness, and includes a third surface (e.g., the first region 4911) facing in the first direction.

According to various embodiments, the electronic device may further include at least one patch antenna (e.g., the patch antenna pattern 4932) on the first surface.

According to various embodiments, the electronic device may further include a wireless communication circuit (e.g., the wireless communication module 192) that transmits/receives a signal in a frequency range between 3.5 GHz and 100 GHz by using the patch antenna.

According to various embodiments, the electronic device may further include at least one dipole antenna (e.g., the dipole antenna pattern 4922) on the second surface.

According to various embodiments, the wireless communication circuit may transmit/receive the signal in the frequency range between 3.5 GHz and 100 GHz by using the dipole antenna.

Figure 8:
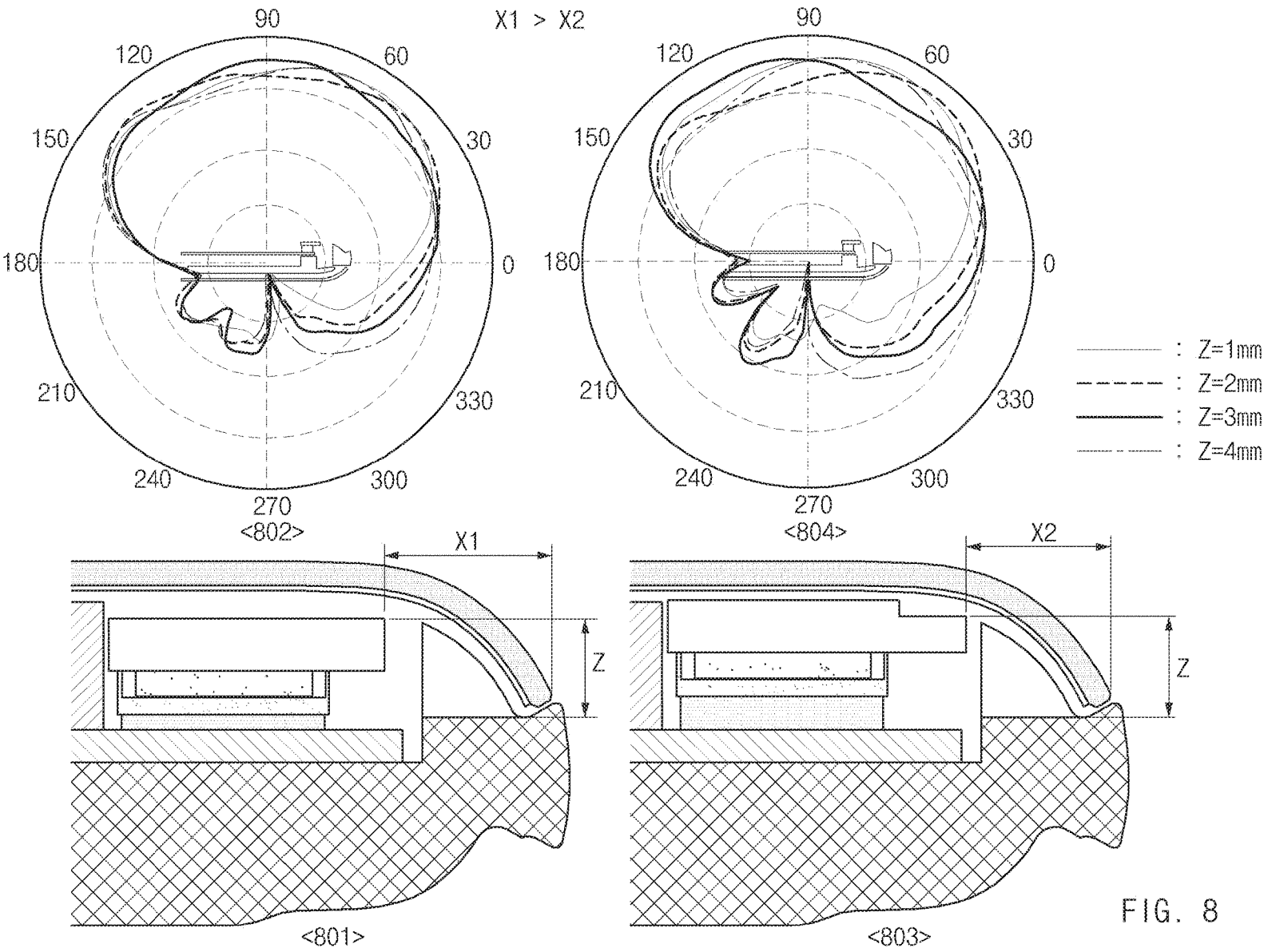
FIG. 8 is a graph illustrating a performance of an antenna module according to an embodiment of the disclosure.

FIG. 8 is a graph illustrating a performance of an antenna module according to an embodiment of the disclosure. That is, FIG. 8 is a graph illustrating a beam performance difference between an electronic device using an antenna module (e.g., the antenna module 490) including the stepped structure according to an embodiment of the disclosure and an electronic device using an antenna module from which a stepped structure is absent.

Referring to FIG. 8, a cross-section view 801 indicates an antenna module from which a stepped structure is absent, and a graph 802 indicates a beam performance of the electronic device using the antenna module from which the stepped structure is absent. In FIG. 8, a cross-section view 803 indicates an antenna module according to an embodiment of the disclosure, and a graph 804 indicates a beam performance of the electronic device using the antenna module according to an embodiment of the disclosure.

According to an embodiment, the electronic device of the cross-section view 801 may have a first horizontal distance X1 between the antenna module and the side bezel structure. The electronic device of the cross-section view 803 may have a second horizontal distance X2 between the antenna module and the side bezel structure. Due to the stepped structure, the second horizontal distance X2 may be smaller than the first horizontal distance X1. For example, it is assumed that the first horizontal distance X1 is 6 mm and the second horizontal distance X2 is 4 mm FIG. 8 is a graph illustrating a beam performance of an electronic device measured while changing a vertical distance "Z" between the antenna module and the side bezel structure in a state where a horizontal distance is fixed. For example, FIG. 8 is a graph illustrating beam performances measured when the vertical distances "Z" are 1 mm, 2 mm, 3 mm, and 4 mm, respectively.

According to an embodiment, it is observed that, when the vertical distance "Z" is 3 mm, a beam performance of the electronic device of the graph 804 is improved as much as approximately 2.32 dB with respect to 0 degree compared with a beam performance of the electronic device of the graph 802. It is observed that, in the case where the vertical distance "Z" is fixed, a beam performance of an electronic device is improved as a horizontal distance decreases. An antenna module (e.g., the antenna module 490) according to an embodiment of the disclosure may be disposed within an electronic device (e.g., an electronic device including a curved portion at a back plate) so as to have a relatively small horizontal distance (X1>X2) through the stepped structure under the condition that a vertical distance is fixed. Accordingly, an electronic device using an antenna module according to an embodiment of the disclosure may implement an improved beam performance.

Figure 9:
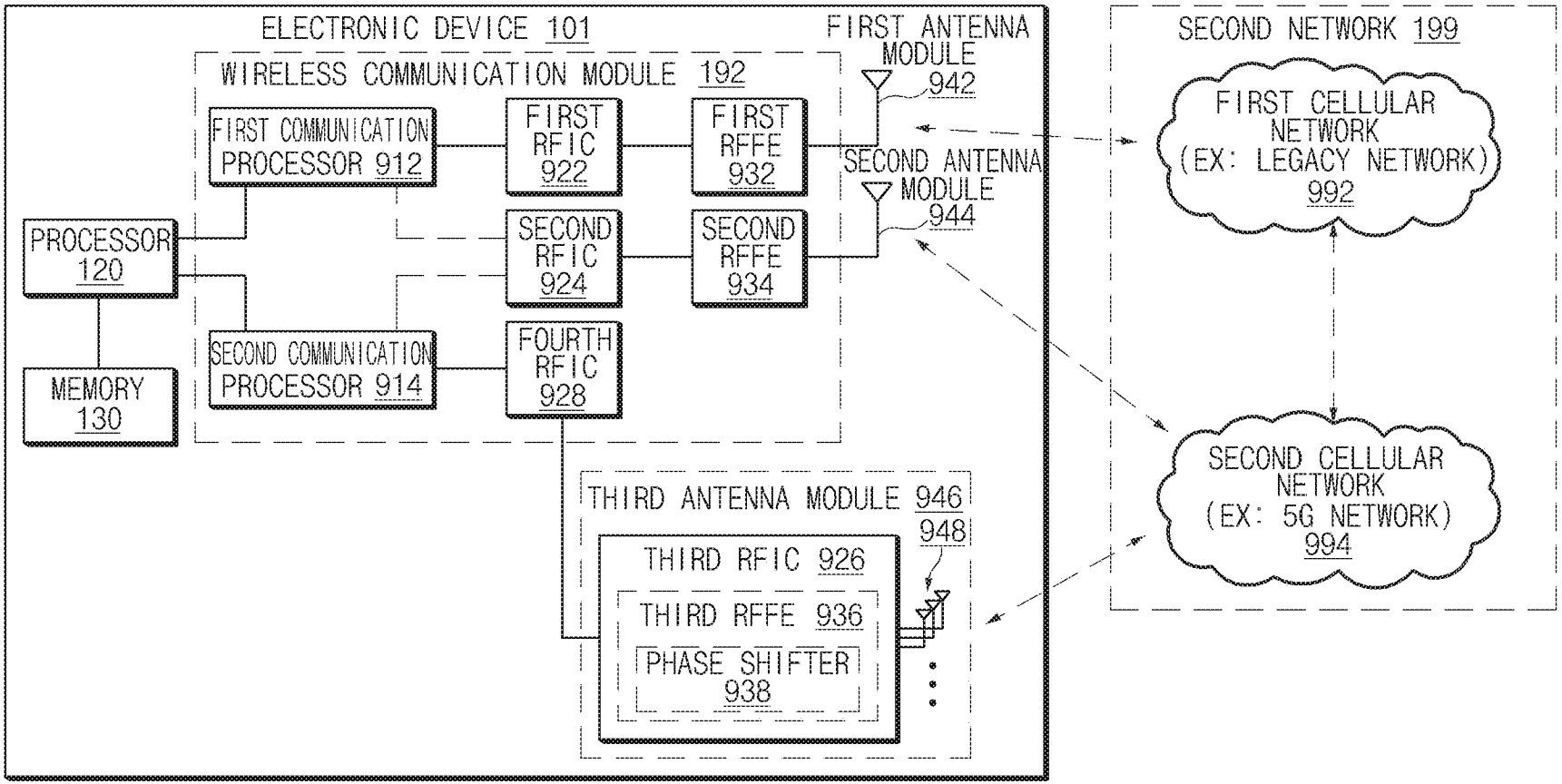
FIG. 9 is a block diagram of an electronic device for supporting legacy network communication and 5th generation (5G) network communication, according to an embodiment of the disclosure.

FIG. 9 is a block diagram of an electronic device for supporting legacy network communication and 5G network communication, according to an embodiment of the disclosure.

Referring to FIG. 9, the electronic device 101 may include a first communication processor 912, a second communication processor 914, a first radio frequency integrated circuit (RFIC) 922, a second RFIC 924, a third RFIC 926, a fourth RFIC 928, a first radio frequency front end (RFFE) 932, a second RFFE 934, a first antenna module 942, a second antenna module 944, and an antenna 948. The electronic device 101 may further include the processor 120 and the memory 130. The network 199 may include a first network 992 and a second network 994. According to another embodiment, the electronic device 101 may further include at least one component of the components illustrated in FIG. 1, and the network 199 may further include at least another network. According to an embodiment, the first communication processor 912, the second communication processor 914, the first RFIC 922, the second RFIC 924, the fourth RFIC 928, the first RFFE 932, and the second RFFE 934 may form at least a portion of the wireless communication module 192. According to another embodiment, the fourth RFIC 928 may be omitted or may be included as a part of the third RFIC 926.

The first communication processor 912 may establish a communication channel for a band to be used for wireless communication with the first network 992 and may support legacy network communication through the established communication channel. According to various embodiments, the first network 992 may be a legacy network including a $2^{nd}$ generation (2G), 3rd generation (3G), 4th generation (4G), or long term evolution (LTE) network. The second communication processor 914 may establish a communication channel corresponding to a specified band (e.g., ranging from approximately 6 GHz to approximately 60 GHz) of bands to be used for wireless communication with the second network 994 and may support 5G network communication through the established communication channel According to various embodiments, the second network 994 may be a 5G network defined in the 3GPP. Additionally, according to an embodiment, the first communication processor 912 or the second communication processor 914 may establish a communication channel corresponding to a specified band (e.g., approximately 6 GHz or lower) of the bands to be used for wireless communication with the second network 994 and may support 5G network communication through the established communication channel According to an embodiment, the first communication processor 912 and the second communication processor 914 may be implemented in a single chip or a single package. According to various embodiments, the first communication processor 912 or the second communication processor 914 may be implemented in a single chip or a single package together with the processor 120, the auxiliary processor 123, or the communication module 190.

In the case of transmitting a signal, the first RFIC 922 may convert a baseband signal generated by the first communication processor 912 into a radio frequency (RF) signal of approximately 700 MHz to approximately 3 GHz that is used in the first network 992 (e.g., a legacy network). In the case of receiving a signal, an RF signal may be obtained from the first network 992 (e.g., a legacy network) through an antenna (e.g., the first antenna module 942) and may be pre-processed through an RFFE (e.g., the first RFFE 932). The first RFIC 922 may convert the pre-processed RF signal into a baseband signal so as to be processed by the first communication processor 912.

In the case of transmitting a signal, the second RFIC 924 may convert a baseband signal generated by the first communication processor 912 or the second communication processor 914 into an RF signal (hereinafter referred to as a "5G Sub6 RF signal") in a Sub6 band (e.g., approximately 6 GHz or lower) used in the second network 994 (e.g., a 5G network). In the case of receiving a signal, the 5G Sub6 RF signal may be obtained from the second network 994 (e.g., a 5G network) through an antenna (e.g., the second antenna module 944) and may be pre-processed through an RFFE (e.g., the second RFFE 934). The second RFIC 924 may convert the pre-processed 5G Sub6 RF signal into a baseband signal so as to be processed by a communication processor corresponding to the 5G Sub6 RF signal from among the first communication processor 912 or the second communication processor 914.

The third RFIC 926 may convert a baseband signal generated by the second communication processor 914 into an RF signal (hereinafter referred to as a "5G Above 6 RF signal") in a 5G Above 6 band (e.g., approximately 6 GHz to approximately 60 GHz) to be used in the second network 994 (e.g., a 5G network). In the case of receiving a signal, the 5G Above 6 RF signal may be obtained from the second network 994 (e.g., a 5G network) through an antenna (e.g., the antenna 948) and may be pre-processed through a third RFFE 936. For example, the third RFFE 936 may perform pre-process the 5G Above 6 RF signal using a phase shifter 938. The third RFIC 926 may convert the pre-processed 5G Above 6 RF signal into a baseband signal so as to be processed by the second communication processor 914. According to an embodiment, the third RFFE 936 may be implemented as a part of the third RFIC 926.

According to an embodiment, the electronic device 101 may include the fourth RFIC 928 independently of the third RFIC 926 or as at least a portion of the third RFIC 926. In this case, the fourth RFIC 928 may convert a baseband signal generated by the second communication processor 914 into an RF signal (hereinafter referred to as an "IF signal") in an intermediate frequency band (e.g., ranging from approximately 9 GHz to approximately 11 GHz) and may provide the IF signal to the third RFIC 926. The third RFIC 926 may convert the IF signal into the 5G Above 6 RF signal. In the case of receiving a signal, the 5G Above 6 RF signal may be received from the second network 994 (e.g., a 5G network) through an antenna (e.g., the antenna 948) and may be converted into an IF signal by the third RFIC 926. The fourth RFIC 928 may convert the IF signal into a baseband signal so as to be processed by the second communication processor 914.

According to an embodiment, the first RFIC 922 and the second RFIC 924 may be implemented with a part of a single package or a single chip. According to an embodiment, the first RFFE 932 and the second RFFE 934 may be implemented with a part of a single package or a single chip. According to an embodiment, at least one of the first antenna module 942 or the second antenna module 944 may be omitted or may be combined with any other antenna module to process RF signals in a plurality of bands.

According to an embodiment, the third RFIC 926 and the antenna 948 may be disposed at the same substrate to form a third antenna module 946. For example, the wireless communication module 192 or the processor 120 may be disposed at a first substrate (e.g., a main PCB). In this case, the third RFIC 926 may be disposed in a partial region (e.g., on a lower surface) of a second substrate (e.g., a sub PCB) independent of the first substrate, and the antenna 948 may be disposed in another partial region (e.g., on an upper surface) of the second substrate. As such, the third antenna module 946 may be formed. According to an embodiment, the antenna 948 may include, for example, an antenna array to be used for beamforming. As the third RFIC 926 and the antenna 948 are disposed at the same substrate, it may be possible to decrease a length of a transmission line between the third RFIC 926 and the antenna 948. The decrease in the transmission line may make it possible to reduce the loss (or attenuation) of a signal in a high-frequency band (e.g., approximately 6 GHz to approximately 60 GHz) used for the 5G network communication due to the transmission line. As such, the electronic device 101 may improve the quality or speed of communication with the second network 994 (e.g., a 5G network).

The second network 994 (e.g., a 5G network) may be used independently of the first network 992 (e.g., a legacy network) (e.g., stand-alone (SA)) or may be used in conjunction with the first network 992 (e.g., non-stand alone (NSA)). For example, only an access network (e.g., a 5G radio access network (RAN) or a next generation RAN (NG RAN)) may be present in the 5G network, and a core network (e.g., a next generation core (NGC)) may be absent from the 5G network. In this case, the electronic device 101 may access the access network of the 5G network and may access an external network (e.g., Internet) under control of a core network (e.g., an evolved packed core (EPC)) of the legacy network. Protocol information (e.g., LTE protocol information) for communication with the legacy network or protocol information (e.g., New Radio (NR) protocol information) for communication with the 5G network may be stored in the memory 130 so as to be accessed by any other component (e.g., the processor 120, the first communication processor 912, or the second communication processor 914).

FIGS. 10A to 10C illustrate a structure of a third antenna module described with reference to FIG. 9, according to various embodiments of the disclosure. In more detail, FIG. 10A is a perspective view of a third antenna module when viewed from one side, and FIG. 10B is a perspective view of the third antenna module when viewed from another side. FIG. 10C is a cross-sectional view of the third antenna module taken along a line A-A' of FIG. 10A.

Referring to FIGS. 10A to 10C, in an embodiment, the third antenna module 946 may include a printed circuit board 1010, an antenna array 1030, an RFIC 1052, a PMIC 1054, and a module interface (not illustrated). Selectively, the third antenna module 946 may further include a shielding member 1090. In various embodiments, at least one of the above components may be omitted, or at least two of the components may be integrally formed.

The printed circuit board 1010 may include a plurality of conductive layers and a plurality of non-conductive layers, and the conductive layers and the non-conductive layers may be alternately stacked. The printed circuit board 1010 may provide electrical connection with various electronic components disposed on the printed circuit board 1010 and/or on the outside, by using wires and conductive vias formed in the conductive layers.

The antenna array 1030 (e.g., 948 of FIG. 9) may include a plurality of antenna elements 1032, 1034, 1036, and 1038 disposed to form a directional beam. The antenna elements 1032, 1034, 1036, and 1038 may be formed on a first surface of the printed circuit board 1010 as illustrated. According to another embodiment, the antenna array 1030 may be formed within the printed circuit board 1010. According to embodiments, the antenna array 1030 may include a plurality of antenna arrays (e.g., a dipole antenna array and/or a patch antenna array), of which shapes or kinds are identical or different.

The RFIC 1052 (e.g., 926 of FIG. 9) may be disposed on another region (e.g., a second surface facing away from the first surface) of the printed circuit board 1010 so as to be spaced from the antenna array 1030. The RFIC 1052 may be configured to process a signal in a selected frequency band, which is transmitted/received through the antenna array 1030. According to an embodiment, in the case of transmitting a signal, the RFIC 1052 may convert a baseband signal obtained from a communication processor (not illustrated) into an RF signal in a specified band. In the case of receiving a signal, the RFIC 1052 may convert an RF signal received through the antenna array 1030 into a baseband signal and may provide the baseband signal to the communication processor.

According to another embodiment, in the case of transmitting a signal, the RFIC 1052 may up-convert an IF signal (e.g., approximately 9 GHz to approximately 11 GHz) obtained from an intermediate frequency integrated circuit (IFIC) (e.g., 928 of FIG. 9) into an RF signal in a selected band. In the case of receiving a signal, the RFIC 1052 may down-convert an RF signal obtained through the antenna array 1030 into an IF signal and may provide the IF signal to the IFIC.

The PMIC 1054 may be disposed on another region (e.g., the second surface) of the printed circuit board 1010, which is spaced from the antenna array 1030. The PMIC 1054 may be supplied with a voltage from a main PCB (not illustrated) and may provide a power necessary for various components (e.g., the RFIC 1052) on an antenna module.

The shielding member 1090 may be disposed on a portion (e.g., on the second surface) of the printed circuit board 1010 such that at least one of the RFIC 1052 or the PMIC 1054 is electromagnetically shielded. According to an embodiment, the shielding member 1090 may include a shield can.

Although not illustrated in the drawings, in various embodiments, the third antenna module 946 may be electrically connected with another printed circuit board (e.g., a main circuit board) through a module interface. The module interface may include a connection member, for example, a coaxial cable connector, a board to board connector, an interposer, a flexible printed circuit board (FPCB), or the like. The RFIC 1052 and/or the PMIC 1054 of the third antenna module 946 may be electrically connected with the printed circuit board through the connection member.

Figure 11:
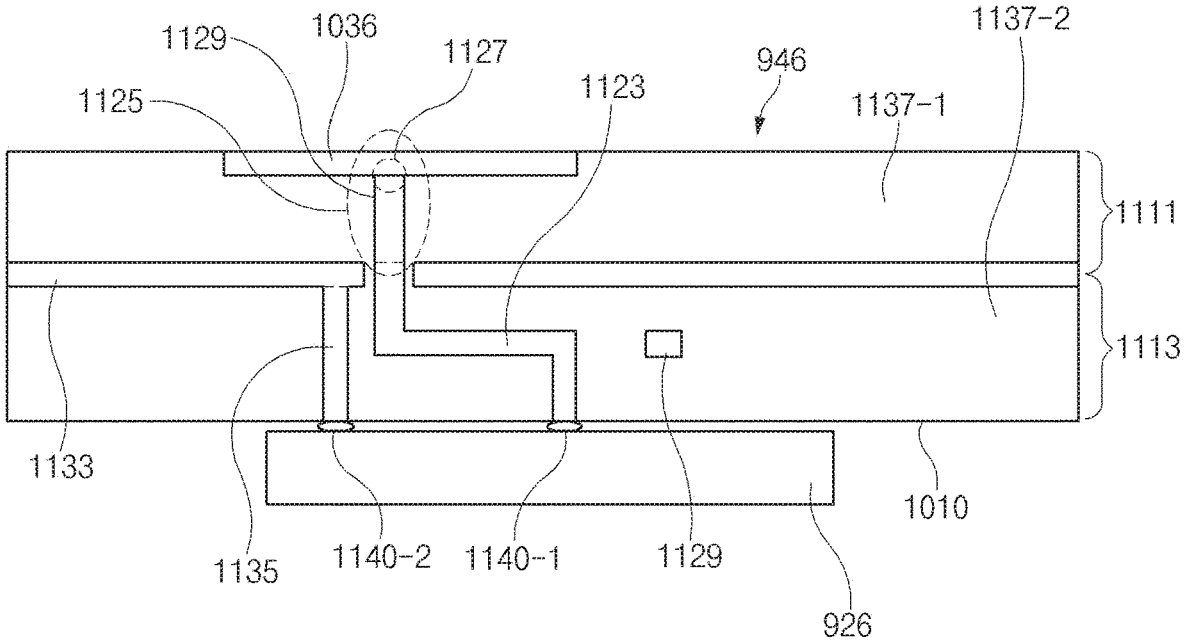
FIG. 11 illustrates a cross-sectional view of a third antenna module taken along a line A-A' of FIG. 10A according to an embodiment of the disclosure.

FIG. 11 illustrates a cross-sectional view of a third antenna module taken along a line A-A' of FIG. 10A according to an embodiment of the disclosure. In an embodiment that is illustrated, the printed circuit board 1010 may include an antenna layer 1111 and a network layer 1113.

Referring to FIG. 11, the antenna layer 1111 may include at least one dielectric layer 1137-1, and an antenna element 1036 and/or a feed part 1125 formed on an outer surface of the dielectric layer 1137-1 or therein. The feed part 1125 may include a feed point 1127 and/or a feed line 1129.

The network layer 1113 may include at least one dielectric layer 1137-2, and at least one ground layer 1133, at least one conductive via 1135, a transmission line 1123, and/or a signal line 1129 formed on an outer surface of the dielectric layer 1137-2 or therein.

In addition, in the embodiment that is illustrated, the third RFIC 926 may be electrically connected with the network layer 1113, for example, through first and second connection parts (e.g., solder bumps) 1140-1 and 1140-2. In various embodiments, various connection structures (e.g., soldering or a ball grid array (BGA)) may be used. The third RFIC 926 may be electrically connected with the antenna element 1036 through the first connection part 1140-1, the transmission line 1123, and the feed part 1125. Also, the third RFIC 926 may be electrically connected with the ground layer 1133 through the second connection part 1140-2 and the conductive via 1135. Although not illustrated, the third RFIC 926 may also be electrically connected with the above module interface through a signal line 1129.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

A method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to embodiments of the disclosure, an influence of a metal component of a housing may be minimized by applying a stepped structure to an antenna module such that a spaced distance between the metal component of the housing and the antenna module is maximized within an electronic device.

Besides, a variety of effects directly or indirectly understood through this disclosure may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing;

a plate attached to the housing to form an inner space together with the housing and including a flat portion facing in a first direction and a curved portion extended from an edge of the flat portion and forming an obtuse angle with the first direction; and an antenna module positioned in the inner space, wherein the antenna module includes:

a first partial layer having a first size, a second partial layer including a first antenna pattern, having a second size smaller than the first size, and stacked on the first partial layer, and a third partial layer including a second antenna pattern, having a third size smaller than the second size, and stacked on the second partial layer, and wherein, when viewed from the first direction, the third partial layer overlaps at least a portion of the flat portion, and at least a portion of the second partial layer overlaps at least a portion of the curved portion.

2. The electronic device of claim 1, wherein the first partial layer includes a first region exposed by a difference between the first size of the first partial layer and the second size of the second partial layer, wherein the second partial layer includes a second region exposed by a difference between the second size and the third size, and wherein the third partial layer includes a third region facing in the first direction.

3. The electronic device of claim 2, further comprising:

a support member fixing the antenna module to a printed circuit board disposed in the housing, wherein the first region has a shape of engaging with a portion of the support member.

4. The electronic device of claim 2, wherein a distance between the flat portion and the third region is smaller than a distance between the curved portion and the second region.

5. The electronic device of claim 2, wherein the first region overlaps at least a portion of the flat portion, when viewed from the first direction.

6. The electronic device of claim 2, wherein the antenna module has a first thickness in the third region, wherein the antenna module has a second thickness smaller than the first thickness in the second region, and wherein the antenna module has a third thickness smaller than the second thickness in the first region.

7. The electronic device of claim 1, wherein the second partial layer includes at least one dipole antenna.

8. The electronic device of claim 7, further comprising:

a wireless communication circuit configured to transmit/receive a signal having a frequency between 3.5 GHz and 100 GHz by using the dipole antenna.

9. The electronic device of claim 7, wherein the first partial layer or the third partial layer includes at least one S-patch antenna for improving a straightness of a signal which is transmitted/received through the dipole antenna.

10. The electronic device of claim 1, wherein the third partial layer includes at least one patch antenna.

11. The electronic device of claim 10, further comprising:

a wireless communication circuit configured to transmit/receive a signal having a frequency between 3.5 GHz and 100 GHz by using the patch antenna.

12. The electronic device of claim 1, further comprising:

a side bezel structure, formed of a metal material, to which the plate is attached, wherein the side bezel structure includes an injection structure of a polymer material, which is disposed at a location corresponding to the antenna module.

13. The electronic device of claim 1, wherein the antenna module further comprises a network layer.

14. The electronic device of claim 13, wherein the network layer comprises:

at least one dielectric layer; and at least one ground layer.

15. The electronic device of claim 14, further comprising a radio frequency integrated circuit (RFIC), wherein the RFIC is electrically connected with an antenna element of the antenna module through a feed part formed within the dielectric layer.

* * * * *